US011351077B2

(12) United States Patent
Patry et al.

(10) Patent No.: US 11,351,077 B2
(45) Date of Patent: Jun. 7, 2022

(54) RECEIVING MODULE FOR CEILING PATIENT LIFT SYSTEM

(71) Applicant: ArjoHuntleigh Magog Inc., Magog (CA)

(72) Inventors: Jocelyn Patry, Sherbrooke (CA); Olivier Custeau-Boisclair, Sherbrooke (CA); Martin Faucher, Magog (CA); Michel Leduc, Magog (CA); Francis Lapointe, Sherbrooke (CA)

(73) Assignee: ArjoHuntleigh Magog Inc., Quebec (CA)

( * ) Notice: Subject to any disclaimer, the term of this patent is extended or adjusted under 35 U.S.C. 154(b) by 170 days.

(21) Appl. No.: 16/609,558

(22) PCT Filed: Apr. 24, 2018

(86) PCT No.: PCT/CA2018/050482
§ 371 (c)(1),
(2) Date: Oct. 30, 2019

(87) PCT Pub. No.: WO2018/201232
PCT Pub. Date: Nov. 8, 2018

(65) Prior Publication Data

US 2020/0054512 A1 Feb. 20, 2020

Related U.S. Application Data

(60) Provisional application No. 62/492,819, filed on May 1, 2017.

(51) Int. Cl.

| | |
|---|---|
| ***A61G 7/10*** | (2006.01) |
| ***B66C 7/02*** | (2006.01) |
| ***B66C 11/06*** | (2006.01) |

(52) U.S. Cl.
CPC ..... *A61G 7/1042* (2013.01); *A61G 7/1001* (2013.01); *A61G 7/1015* (2013.01);
(Continued)

(58) Field of Classification Search
CPC .. A61G 7/1042; A61G 7/1015; A61G 7/1061; A61G 7/1063; A61G 7/1049;
(Continued)

(56) References Cited

U.S. PATENT DOCUMENTS

| | | | |
|---|---|---|---|
| 6,381,139 | B1 | 4/2002 | Sun |
| 6,675,412 | B2 | 1/2004 | Faucher et al. |

(Continued)

FOREIGN PATENT DOCUMENTS

| | | | |
|---|---|---|---|
| CN | 201996766 | U | 10/2011 |
| CN | 103906495 | A | 7/2014 |

(Continued)

OTHER PUBLICATIONS

Office Action issued in CN201880029043.9 dated Nov. 3, 2020.
Partial Supplementary European Search Report issued in EP18794082.0 dated Jan. 11, 2021.

*Primary Examiner* — David R Hare
*Assistant Examiner* — Madison Emanski
(74) *Attorney, Agent, or Firm* — The Webb Law Firm

(57) ABSTRACT

A receiving module for a ceiling patient lift including a housing defining an internal cavity configured to hold a motor unit, a door hingedly connected to a side face of the housing, the door movable between an open position and a closed position, a slider element operatively connected to the housing, at least one retaining member connected to the slider element and slidably receiving in a side face of the housing, at least one counter support provided on an upper surface of the housing, and at least one ramp member provided in the internal cavity of the housing.

13 Claims, 18 Drawing Sheets

(52) U.S. Cl.
CPC ..... *A61G 7/1049* (2013.01); *A61G 7/1061* (2013.01); *A61G 7/1063* (2013.01); *B66C 7/02* (2013.01); *B66C 11/06* (2013.01)

(58) Field of Classification Search
CPC ..... A61G 7/1001; A61G 2203/30; A61G 2203/12; B66C 7/02; B66C 11/06; A61H 2201/50; A61H 2201/501; A61H 2201/5061; A61H 2201/5064; A61H 2201/5079; A61H 2201/5084; A61H 2201/5092; A61H 2201/5097; A61H 3/008; A63B 2022/0094; A63B 2024/0093; A63B 2220/10; A63B 2220/30; A63B 2220/40; A63B 2220/51; A63B 2220/52; A63B 2220/802; A63B 2220/806; A63B 2225/107; A63B 2225/20; A63B 2225/50; A63B 24/0087; A63B 69/0064
See application file for complete search history.

(56) References Cited

U.S. PATENT DOCUMENTS

| | | | | |
|---|---|---|---|---|
| 7,237,491 | B2 | 7/2007 | Faucher et al. | |
| 8,701,226 | B2 | 4/2014 | Faucher et al. | |
| 2009/0199335 | A1 | 8/2009 | Guldmann | |
| 2012/0000876 | A1 | 1/2012 | Bergenstråle et al. | |
| 2013/0019401 | A1 | 1/2013 | Faucher et al. | |
| 2013/0232885 | A1 | 9/2013 | Gallant et al. | |
| 2014/0201905 | A1 | 7/2014 | Glukhovsky | |
| 2018/0280221 | A1 * | 10/2018 | Chandan | G08B 5/36 |
| 2020/0138657 | A1 | 5/2020 | Chandan et al. | |

FOREIGN PATENT DOCUMENTS

| | | | | |
|---|---|---|---|---|
| DE | 19851708 | A1 | 5/2000 | |
| EP | 2777674 | A1 * | 9/2014 | A61G 7/1015 |
| EP | 2777674 | A1 | 9/2014 | |
| WO | 2009104096 | A2 | 8/2009 | |
| WO | 2013011367 | A2 | 1/2013 | |
| WO | 2017059526 | A1 | 4/2017 | |

* cited by examiner

RECEIVING MODULE FOR CEILING PATIENT LIFT SYSTEM

CROSS-REFERENCE TO RELATED APPLICATIONS

This application is the United States national phase of International Application No. PCT/CA2018/050482 filed Apr. 24, 2018, and claims priority to U.S. Provisional Patent Application No. 62/492,819 filed May 1, 2017, the disclosures of which are hereby incorporated by reference in their entirety.

BACKGROUND OF THE INVENTION

Field of the Invention

The present disclosure relates, generally, to patient lift systems and their components and assemblies, and, more particularly, to a hoist carriage or receiving module for a patient lift system.

Description of Related Art

Patient lifts are commonly used in hospitals and other care centers, as well as in the homes of those with mobility impairments, to convey people and/or equipment to different areas of a building, for example, from a bed to a bathroom or from a bed to a chair. Patient lifts permit the movement of the individual with far decreased effort on the part of the caregiver, all while helping to preserve the comfort and dignity of the immobile individual. Patient lifts can be used in acute care facilities, hospitals, long term care facilities, nursing facilities, hospices, and homes or any type of environment where healthcare services are provided and/or patient handling is needed.

One type of patient lift includes a ceiling lift. Ceiling lifts use ceiling hoist technology, which hoists the person from above using various forms of hoists. One form of such a ceiling lift is a lift that is able to travel on one or more tracks that are suspended from the ceiling or elevated structure. Such lift systems include fixed ceiling lifts, where the track is affixed to the ceiling and the lifting assembly is directly attached to the track, and portable ceiling lifts, where the lift assembly is removably attached to the ceiling track or a member attached to the ceiling track. Some examples of such lift systems are shown in U.S. Pat. No. 7,237,491 to Faucher et al., U.S. Pat. No. 6,675,412 to Faucher et al., and U.S. Pat. No. 8,701,226 to Faucher et al., each incorporated herein by reference in its entirety. In the example shown in U.S. Pat. No. 8,701,226, the components of the assembly may communicate power and data between them, utilizing a control unit mounted on a wall or elsewhere.

Several ceiling patient lift systems include a trolley, carriage, or other receiving module operatively connected to the track mounted on the ceiling or elevated structure. These receiving modules are attachable to a motor unit used to raise and lower the hoist unit of the system. In some systems, the receiving module is configured to receive a variety of motor units that are interchangeable within the receiving module so that, depending on the weight and condition of the individual to be lifted, an appropriate motor unit is used in the lift assembly to hoist the individual. There is a need, however, for receiving modules that provide an easy and efficient method of interchanging motor units, such that it is often difficult for an individual to remove and insert a different motor unit. Conventional receiving modules can require an extended amount of time and effort to remove an installed motor unit and replace it with a different motor unit. Additionally conventional receiving modules do not have enhanced safety features to ensure that the motor unit is secured to the receiving module.

SUMMARY OF THE INVENTION

In view of the foregoing, there is a current need for a receiving module for a patient lift system that allows for an easy and efficient replacement of a motor unit within the receiving module. Further, there is a current need for a receiving module that is self-securing and prevents inadvertent unlocking of the receiving module when a motor unit is held therein.

In one aspect of the disclosure, a receiving module for a ceiling patient lift includes a housing defining an internal cavity configured to hold a motor unit, a door hingedly connected to a side face of the housing, the door movable between an open position and a closed position, a slider element operatively connected to the housing, at least one retaining member connected to the slider element and slidably receiving in a side face of the housing, at least one counter support provided on an upper surface of the housing, and at least one ramp member provided in the internal cavity of the housing.

Further aspects will now be described in the following numbered clauses.

Clause 1: A lift system for lifting and transferring a person, wherein the lift system comprises: a hoist assembly for lifting a person; and a receiving module engagable with a track, wherein the receiving module comprises: a housing for removably receiving a portion of the hoist assembly such that the hoist assembly is detachably coupled to the housing; a pivotable door allowing access to an interior cavity of the housing and securing the portion of the hoist assembly within the housing, wherein the door is movable between a first position in which it is closed, preventing access to the interior cavity of the housing and a second position in which the door is open, actuating a brake for securing the receiving module relative to the track.

Clause 2: The lift system of Clause 1, wherein, in the open position, the door engages a portion of the track, locking the door to the track in the open position.

Clause 3: The lift system of Clause 1, wherein the door is configured to be snap fit with respect to a portion of the track, thereby locking the door to the track in the open position.

Clause 4: The lift system of Clause 1, wherein the door is pivotably hinged to the housing about a pivot point spaced apart from the track, and wherein the door further comprises a friction point adjacent to and offset from the pivot point, said friction point positionable between the pivot point and the track to secure the door to the track in the open position and prevent movement of the receiving module.

Clause 5: The lift system of Clause 1, wherein the door is pivotably hinged to the housing about a pivot point spaced apart from the track, and wherein the door further comprises a tongue with a tab at an end thereof adjacent to and offset from the pivot point.

Clause 6: The lift system of any one of the preceding Clauses, wherein the housing is configured as a housing comprising four side faces, an upper face and a lower face, wherein a slot is defined within the lower face for accommodating a portion of the hoist assembly.

Clause 7: The lift system of any one of the preceding Clauses, wherein the door is pivotably positioned by a user in the first and second positions by manually rotating the door.

Clause 8: The lift system of any one of the preceding Clauses, wherein the receiving module further comprises a slider element comprising a retaining member traversing the width of the housing, wherein the slider element is slidably movable in a vertical direction to allow access to the interior cavity of the housing and to secure the portion of the hoist assembly within the housing.

Clause 9: The lift system of Clause 8, wherein the housing comprises two slots on opposing side faces of the housing for receiving retaining elements of the slider element, wherein opposing ends of the retaining elements extend through and beyond the sides of the housing, allowing a user to discern the position of the retaining member from the exterior of the receiving module.

Clause 10: The lift system of Clause 9, wherein the opposing ends of the retaining member each comprise a head having a width wider than the slots to secure the retaining member within the slots.

Clause 11: The lift system of any one of Clauses 8-10, wherein the retaining member is configured as a rivet.

Clause 12: The lift system of any one of Clauses 8-11, wherein the slider element further comprises a locking tab extending towards the door and engageable with a slot in the door to lock the door in the closed position.

Clause 13: The lift system of Clause 12, wherein the locking tab is friction fitted to the slot in the door to secure the door in the closed position.

Clause 14: The lift system of any one of Clauses 8-13, wherein the slider element is slidably positioned by a user in a vertical direction by manually lifting and lowering one of the retaining member and locking tab.

Clause 15: The lift system of any one of Clauses 8-14, wherein the slider element is movable from an open position allowing access to the interior cavity of the housing and a closed position for securing the hoist assembly within the housing, and wherein the lift system comprises a sensor for detecting the open and/or closed position of the slider element.

Clause 16: The lift system of any one of the preceding Clauses, wherein the housing has a seat adjoining an edge of the housing opening adjacent to the door, to secure the portion of the hoist assembly within the housing.

Clause 17: The lift system of Clause 15, wherein the seat is configured as a ramp member.

Clause 18: The lift system of Clause 15, wherein the ramp member is tapered, decreasing in height as it extends away from the housing opening and the door.

Clause 19: The lift system of any one of Clauses 15-17, wherein two of the ramp members are positioned on opposing sides of the seat for contacting opposing lower surfaces of the hoist assembly.

Clause 20: The lift system of any of the preceding Clauses, further comprising a counter support for adjusting the position of the receiving module so that it is substantially stable and/or level when the door is open and/or when receiving the portion of the hoist assembly within the housing.

Clause 21: The lift system of Clause 20, wherein the receiving module comprises a flange removably received within the track and attached to the housing extending below the connector, and wherein the counter support is configured as a protrusion extending upwards from an upper surface of a distal end of the housing opposite of the door.

Clause 22: The lift system of Clause 21, wherein, when the door is in the closed position, the protrusion is spaced apart from the lower surface of the track, and when the door is in the open position and/or the hoist is being loaded within the housing, the protrusion engages the lower surface of the track, substantially preventing rocking of the receiving module.

Clause 23: The lift system of Clause 22, wherein when the protrusion engages opposite sides of the track.

Clause 24: The lift system of Clause 20, wherein the receiving module comprises a flange removably received within the track and attached to the housing extending below the connector, and wherein the counter support is configured as a protrusion extending upwards from an upper surface of a distal end of the flange opposite of the door.

Clause 25: The lift system of Clause 24, wherein, when the door is in the closed position, the protrusion is spaced apart from a surface of the track, and, when the door is in the open position and/or the hoist assembly is being loaded within the housing, the protrusion engages the lower surface of the track, substantially preventing rocking of the receiving module.

Clause 26: The lift system of Clause 25, wherein when the protrusion engages opposite sides of the track.

Clause 27: The lift system of any one of the preceding Clauses, wherein the door further comprises a tab extending from a side of the door out beyond a side of the housing to facilitate opening and closing of the door.

Clause 28: The lift system of any one of the preceding Clauses, wherein the door comprises a pair of tabs extending from opposing sides of the door out beyond the sides of the housing to facilitate opening and closing of the door.

Clause 29: The lift system of any one of the preceding Clauses, wherein the system comprises a sensor for detecting an open and/or a closed position of the door with respect to the housing.

Clause 30: The lift system of any one of the preceding Clauses, wherein the system comprises a sensor for detecting a locked or unlocked state of the receiving module with respect to the track.

Clause 31: The lift system of any one of the preceding Clauses, wherein the hoist assembly comprises a hoist connector and a motor unit extending therefrom.

Clause 32: The lift system of Clause 21, wherein the hoist connector comprises a set of wheels that may be removably housed within the housing and rotatably engage with the track.

Clause 33: The lift system of Clause 32, wherein the motor unit extends below the hoist connector and the housing.

Clause 34: The lift system of any one of Clauses 31-33, wherein the hoist assembly further comprises a strap extending from the motor unit and a spreader bar connected to the strap, wherein the spreader bar may be removably attached to a sling for supporting a person.

Clause 35: The lift system of any one of the preceding Clauses, wherein the receiving module is removably attached to the track, and wherein the receiving module comprises a plurality of wheel bearings movable along a length of the track.

Clause 36: The lift system of any of the preceding Clauses, further comprising the track.

Clause 37: The lift system of any of the preceding Clauses, wherein the receiving module and the hoist assembly are electrically connected and may be powered by a single source and/or may be directed by a single controller.

Clause 38: A receiving module for a lift system, wherein the receiving module comprises: a housing for removably receiving a portion of a hoist assembly such that the hoist assembly is detachably coupled to the receiving module; and a pivotable door allowing access to an interior cavity of the housing and securing the portion of the hoist assembly within the housing, wherein the door is movable between a first position in which the door is closed, preventing access to the housing, and a second position in which the door is open.

Clause 39: A receiving module for a lift system of Clause 38, further comprising the hoist assembly.

Clause 40: A receiving module for a lift system, wherein the receiving module comprises: a housing for removably receiving a portion of a hoist assembly such that the hoist assembly is detachably coupled to the housing; and a slider element comprising a retaining member traversing the width of the housing, wherein the slider element and retaining member are slidably movable in a vertical direction to allow access to the interior cavity of the housing and to secure the portion of the hoist assembly within the housing.

Clause 41: The receiving module of Clause 40, wherein the housing comprises two slots on opposing sides of the housing for receiving the retaining member, wherein opposing ends of the retaining member extends through and beyond the sides of the housing, allowing a user to discern the position of the retaining member from the exterior of the receiving module.

Clause 42: The receiving module of Clause 41, wherein the opposing ends of the retaining member each comprise a head having a width wider than the slots to secures the retaining member within the slots.

Clause 43: The receiving module of any one of Clauses 40-42, wherein the retaining member is configured as a rivet.

Clause 44: The receiving module of any one of Clauses 40-43, wherein the slider element further comprises a locking tab extending towards a door of the housing and engageable within the door to lock the door in the closed position.

Clause 45: The receiving module of Clause 44, wherein the locking tab is friction fitted to a slot in the door to secure the door in the closed position.

Clause 46: The receiving module of any one of Clauses 40-45, wherein the slider element is slidably positioned by a user in a vertical direction by manually lifting and lowering one of the retaining member and locking tab.

Clause 47: The receiving module of any one of Clauses 40-46, wherein the slider element is movable from an open position allowing access to the interior cavity of the housing and a closed position for securing a hoist assembly within the housing, and wherein the lift system comprises a sensor for detecting the open and/or closed position of the slider element.

Clause 48: The receiving module of any one of Clauses 40-47, further comprising the hoist assembly.

Clause 49: A receiving module for a lift system, wherein the receiving module comprises: a housing for removably receiving a portion of a hoist assembly such that the hoist assembly is detachably coupled to the housing; a pivotable door allowing access to an interior cavity of the housing and securing the portion of the hoist assembly within the housing, wherein in the door is movable between a first position in which it is closed, preventing access to the housing and a second position in which the door is open; and a counter support for adjusting the position of the receiving module so that the receiving module is substantially level and/or stable when the door is open and/or when receiving the portion of the hoist assembly within the housing.

Clause 50: The receiving module of Clause 49, further comprising the hoist assembly.

Clause 51: A receiving module for a lift system, wherein the receiving module comprises: a housing for removably receiving a portion of a hoist assembly such that the hoist assembly is detachably coupled to the housing; an opening allowing access to an interior cavity of the housing, wherein the housing has a floor comprising a ramp member adjoining an edge of the housing opening to secure a portion of the hoist assembly within the housing.

Clause 52: The receiving module of Clause 49, further comprising the hoist assembly.

These and other features and characteristics of the receiving module, as well as the methods of operation and functions of the related elements of the system, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE DISCLOSURE

Figure 1:
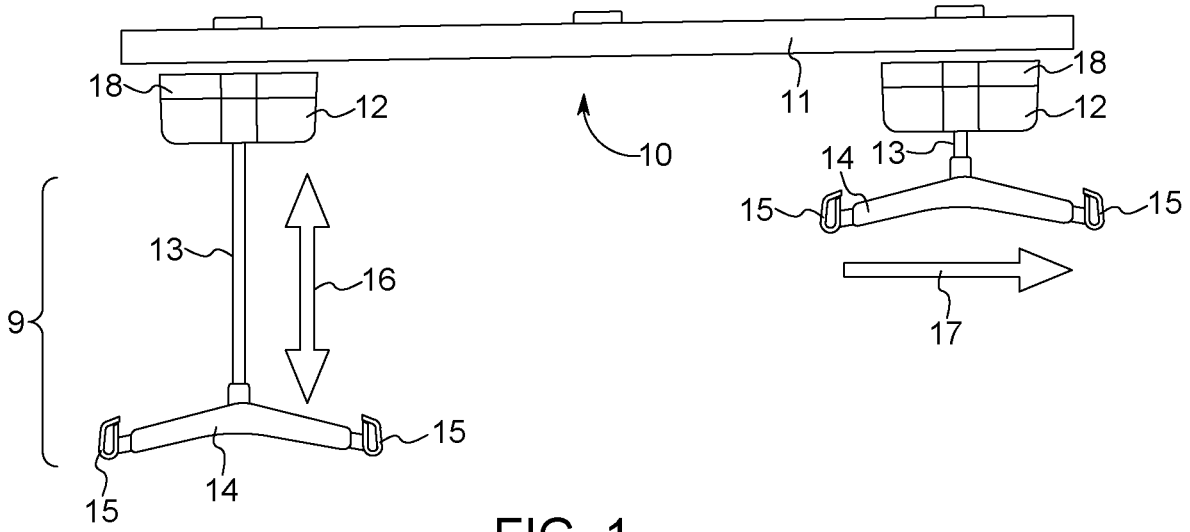
FIG. 1 is a side view of a ceiling patient lift system according to one aspect of the present disclosure.

For purposes of the description hereinafter, the terms "upper", "lower", "right", "left", "vertical", "horizontal", "top", "bottom", "lateral", "longitudinal", and derivatives thereof, shall relate to the invention as it is oriented in the figures. However, it is to be understood that the invention may assume alternative variations and step sequences, except where expressly specified to the contrary. It is also to be understood that the specific systems and processes illustrated in the attached drawings, and described in the following specification, are simply exemplary examples of the invention. Hence, specific dimensions and other physical characteristics related to the examples disclosed herein are not to be considered as limiting.

The present application is directed to a receiving module 18 of a patient lift system 10. In an exemplary embodiment, the application is directed to patient lift system 10 including a receiving module 18 configured as a trolley and/or carriage. System 10 may optionally further include: one or more tracks 11 that are attached to or suspended from a ceiling or other elevated structure along which a receiving module 18 is configured to ride, a hoist assembly 12, a portion of which may be removably secured within the receiving module 18; and/or a lift assembly 9.

Figure 4:
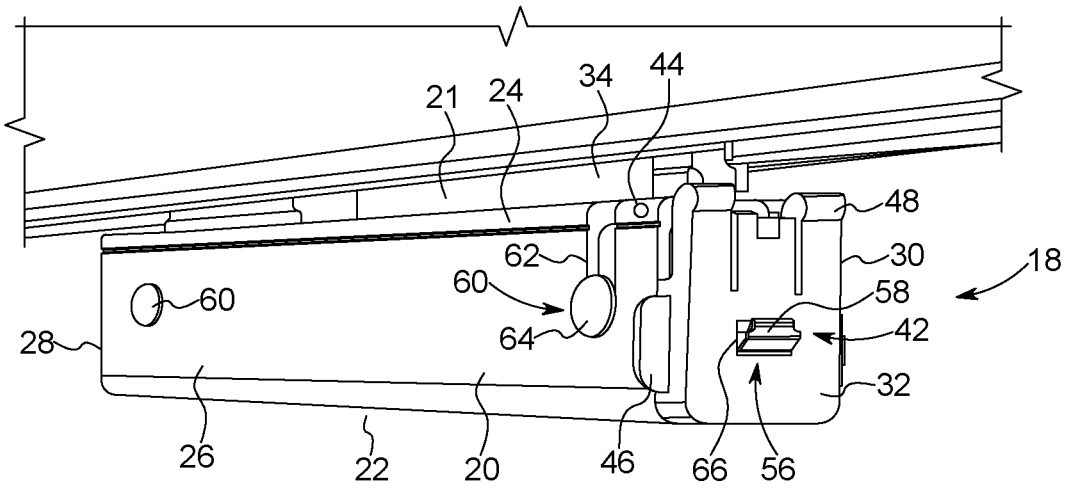
FIG. 4 is a perspective view of a receiving module according to one aspect of the present disclosure positioned on a track.

The track (or tracks, if multiple tracks are used) 11 may be attached directly to the ceiling or elevated structure or suspended from the ceiling or elevated structure. The track (s) 11 may be a profiled track that has a rolling surface for engaging the receiving module 18. The track(s) 11 may be straight, curved, or any other desired configuration that facilitates movement of a patient conveyance to a desired location. The track(s) 11 may further include both upper and lower tracks 11 with the receiving module 18 traveling along an upper track so that the hoist assembly 12 can move in two dimensions (in both the direction of the upper track and the direction of the lower track). This configuration is illustrated in FIG. 4 and described at paragraphs [0015] and [0020]-[0023] of U.S. Pat. No. 8,701,226, which are incorporated by reference herein. A track assembly may also be configured as an X-Y system having a primary rail and a transverse rail, such as that shown in U.S. Pat. No. 7,237,491 (see, for example, FIGS. 12-19 and described at column 19, lines 8-67 through column 20, lines 1-65, all incorporated by reference herein). The track(s) 11 may be made of any suitable material, such as metal or rigid plastic. Alternatively, the track(s) 11 may be flexible or articulated so that they may be bendable and oriented as desired. For example, the track(s) 11 may be made of a semi-flexible plastic material. Further, the track assemblies may be fixed-track systems or moving track systems, such as that shown in FIG. 4 and described in paragraphs [0010] and [0020]-[0021] of U.S. Pat. No. 8,701,226, all incorporated by reference herein.

The track(s) 11 may transmit power and/or communicate data to the receiving module 18. An example of how the track 11 may transmit power or data to a receiving module 18 is described in U.S. Pat. No. 8,701,226, which is incorporated by reference herein. Thus, a control unit, which is mounted on a wall or elsewhere, may communicate power and/or data to the receiving module by way of the track(s).

The receiving module 18 is removably attached to and moveable along the track(s) 11 for transferring and positioning a hoist assembly 12 attached thereto. The receiving module 18 is attached, directly or indirectly as described below, to the hoist assembly 12. The receiving module 18 may include wheels that engage the track(s) 11. Alternatively, the relationship between the track(s) 11 and the receiving module 18 may be frictional. The receiving module 18 may receive a hoist assembly 12 including a motor unit configured to operate the hoist assembly 12 to raise and lower the individual. The receiving module 18 is configured to receive various types of hoist assemblies 12 that are used based on the conditions and weight of the individual to be lifted.

The hoist assembly 12, which raises and lowers the lift assembly 9, may have a winding unit or assembly for winding and unwinding the flexible load-supporting member 13. The hoist assembly 12 is driven by the motor unit and transmission components held in the receiving module 18. The winding assembly may include a drum upon which the flexible load-supporting member 13 is wound. In some examples, the hoist assembly 12 can be replaceable within the receiving module 18 with a different type of hoist assembly 12 to accommodate different hoisting conditions for the patient.

The lift assembly 9, which may be connected to and positioned below the hoist assembly 12, includes or is configured to connect to a patient lift support or conveyance 19. For example, the patient support or conveyance 19 may be a sling, harness, basket or the like. The lift assembly 9 may also include a lifting or spreader bar 14, or a mounting block for supporting the patient support or conveyance 19. The lift assembly 9 and/or its components may be powered and also may generate, use, and/or communicate data, by way of, for example, visual displays, sensors, sound emitting components, controls, and the like. For example, the lift assembly 9 may include load cells for monitoring a patient's weight distribution in the conveyance, a visual display or aural communication of a patient's overall weight and weight distribution in the conveyance, an alarm of some nature that indicates an unsafe condition, and/or an emergency stop for halting the raising or lowering of the lift assembly or the traveling of the receiving module on the track(s). In one example, a lifting bar, spreader bar, or mounting block 14 may include load cells.

The flexible load-supporting member 13 may be a strap, a cable, or the like. The flexible load-supporting member 13 is load-bearing and may include integrated load-bearing power and/or data communication lines, for example, light transmitters, electrical power conductors, data or signal conductors, and the like, that transmit power and/or data along the length of the load-supporting member. In one example, the load bearing components, communications and power transmitting components are integral with the flexible load-supporting member. The flexible load-supporting member 13 may be located between the hoist assembly 12 and the lift assembly 9 or between the receiving module 18 and the hoist assembly 12, and transmits power and/or communications between the hoist assembly 12 and the lift assembly 9 if configured in that manner or between the receiving module 18 and the hoist assembly 12, if configured in that manner. The flexible load-supporting member 13 may be a strap, a cable, or the like, and may be formed of webbing, mesh, braided cable, layered cable, and the like, with the power and/or data lines defining strands or layers therein.

Figure 2:
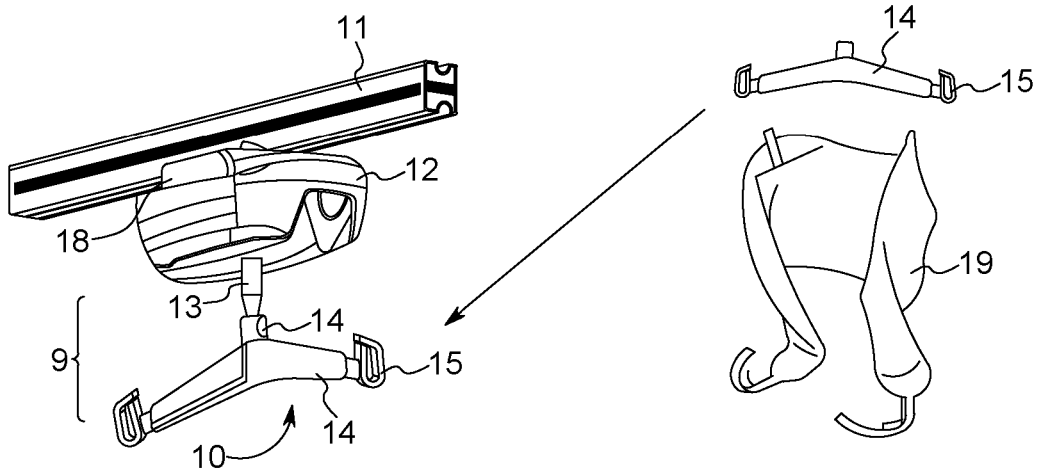
FIG. 2 is a perspective view of another aspect of a ceiling patient lift system of the present disclosure.
Figure 3:
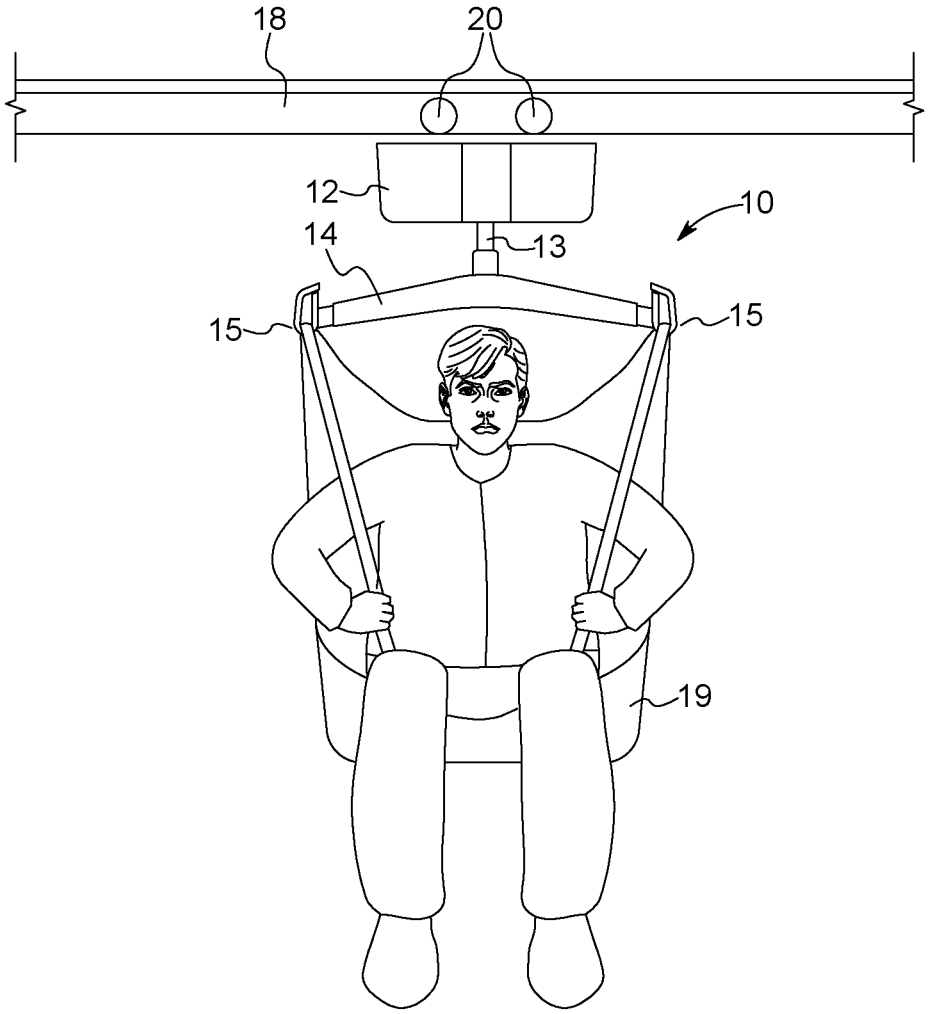
FIG. 3 is a side view depicting an individual being hoisted by the ceiling patient lift system of FIG. 1.

As set forth above, in exemplary embodiments, ceiling patient lift systems 10 may be configured as fixed ceiling lifts and portable ceiling lifts. Examples of a fixed ceiling lift are shown in FIGS. 1-3. FIG. 1 shows an example of a fixed ceiling patient lift system 10 (hereinafter "system 10"). The system 10 includes track 11, a receiving module 18, a hoist assembly 12, a flexible load-supporting member 13, and a lift assembly 9. In one aspect, the lift assembly 9 may include a spreader bar 14 having attachment handles 15 or other means of attaching a patient support and/or a patient support or conveyance 19. As indicated by arrow 16 in FIG. 1, the spreader bar 14 may move in a vertical direction by retracting the flexible load-supporting member 13 to, for example, raise a patient from a bed, chair, gurney, or the like. As indicated by arrow 17, the hoist assembly 12 with the flexible load-supporting member 13 and the spread bar 14 (and hence the patient conveyance) may be moved horizontally to move a patient from one location to another. FIG. 3 shows the system 10 carrying a patient to a desired location using a sling 19 connected to the spreader bar 14 as a conveyance for the patient.

Although the track 11 as shown is straight, the track 11 may be curved, circular, or some other configuration depending on the specific need. In an exemplary aspect, the combination of a track system 11, receiving module 18, hoist assembly 12, flexible load-supporting member 13, spreader bar or lifting bar 14, and a patient support or conveyance 19 is referred to collectively as a ceiling patient lift system 10. Although the present disclosure is described with reference to the use of tracks 11, it is also contemplated that the system 10 can be used with other elevated lift assemblies.

FIG. 2 shows another fixed ceiling lift system 10 having a track 11, a receiving module 18, a hoist assembly 12, and a lift assembly 9 including a flexible load-supporting member 13, a spreader bar 14, and handles 15. Further shown is a sling 19, which may be attached to the handles 15 to provide a conveyance for a patient or equipment.

Figure 5:
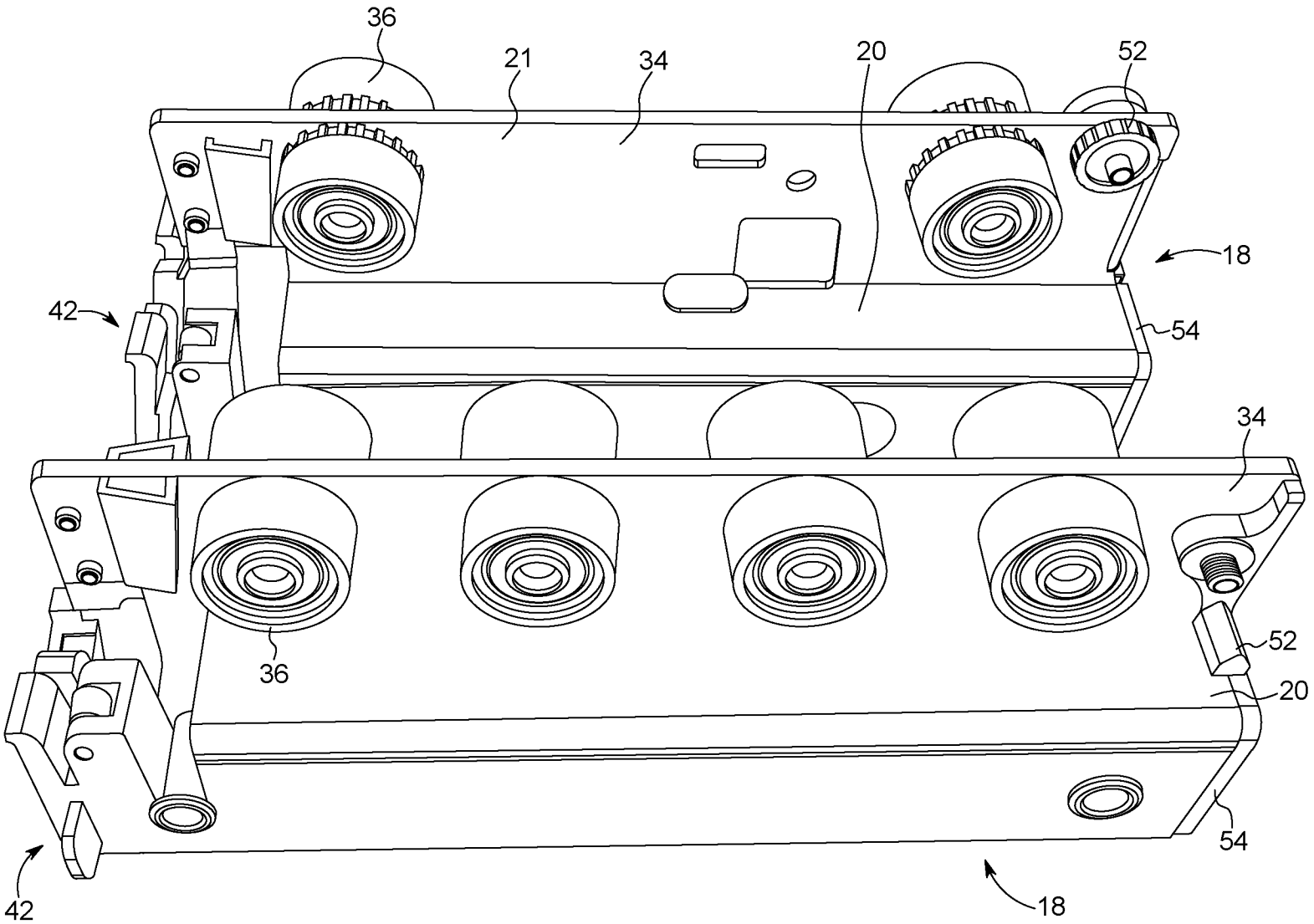
FIG. 5 is a perspective view of two different receiving modules according to aspects of the present disclosure.
Figure 6:
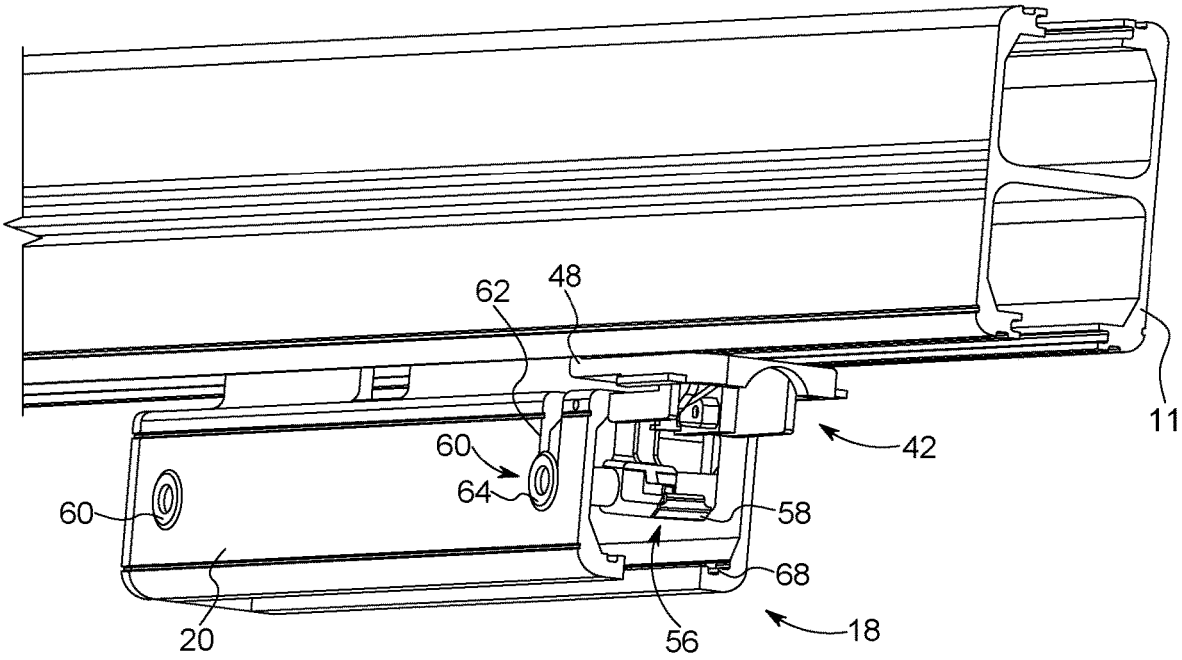
FIG. 6 is a perspective view of the receiving module of FIG. 4 with a door in an open position.
Figure 7:
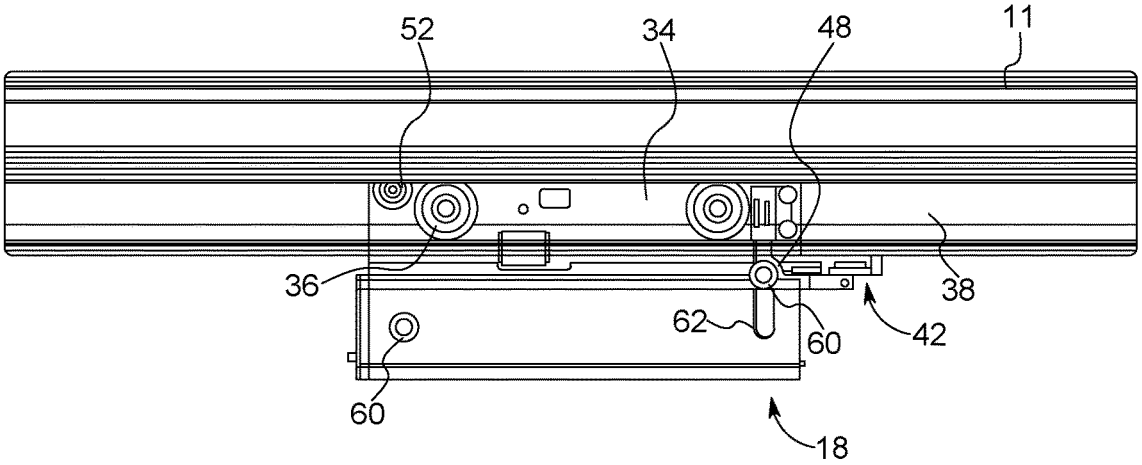
FIG. 7 is a side view of the receiving module of FIG. 4 with the door in the open position.
Figure 8:
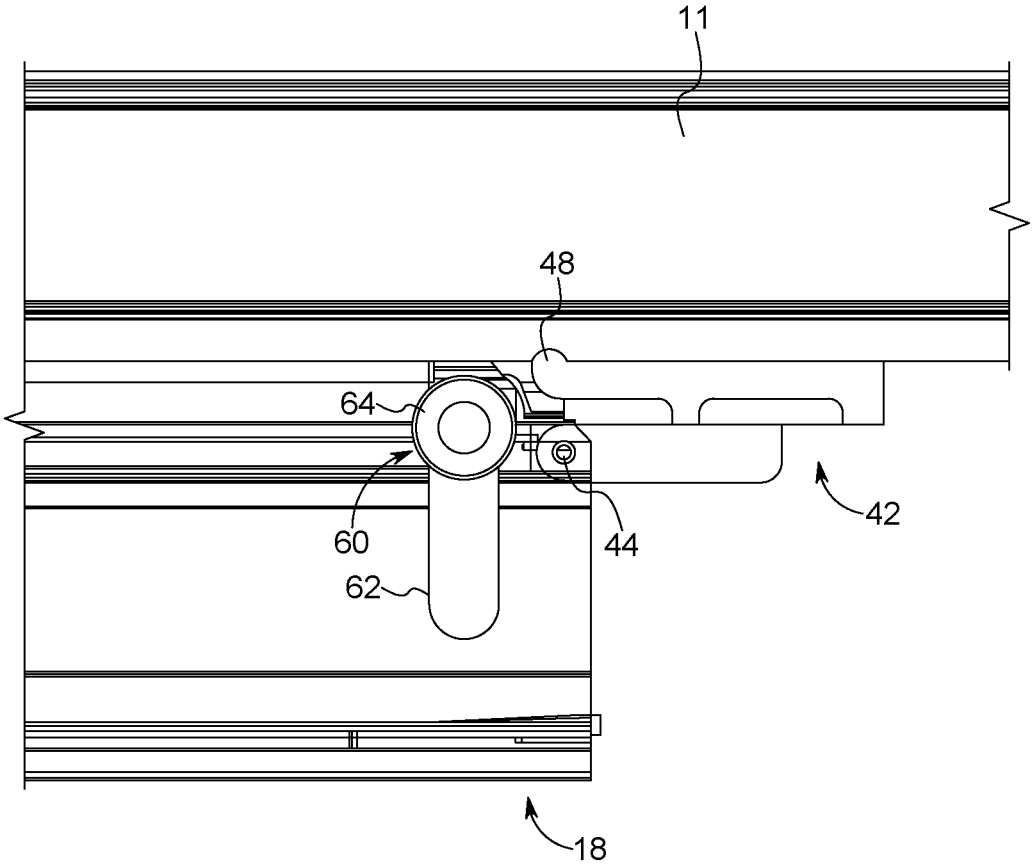
FIG. 8 is a side view of the receiving module of FIG. 4 with the door in the open position.
Figure 9:
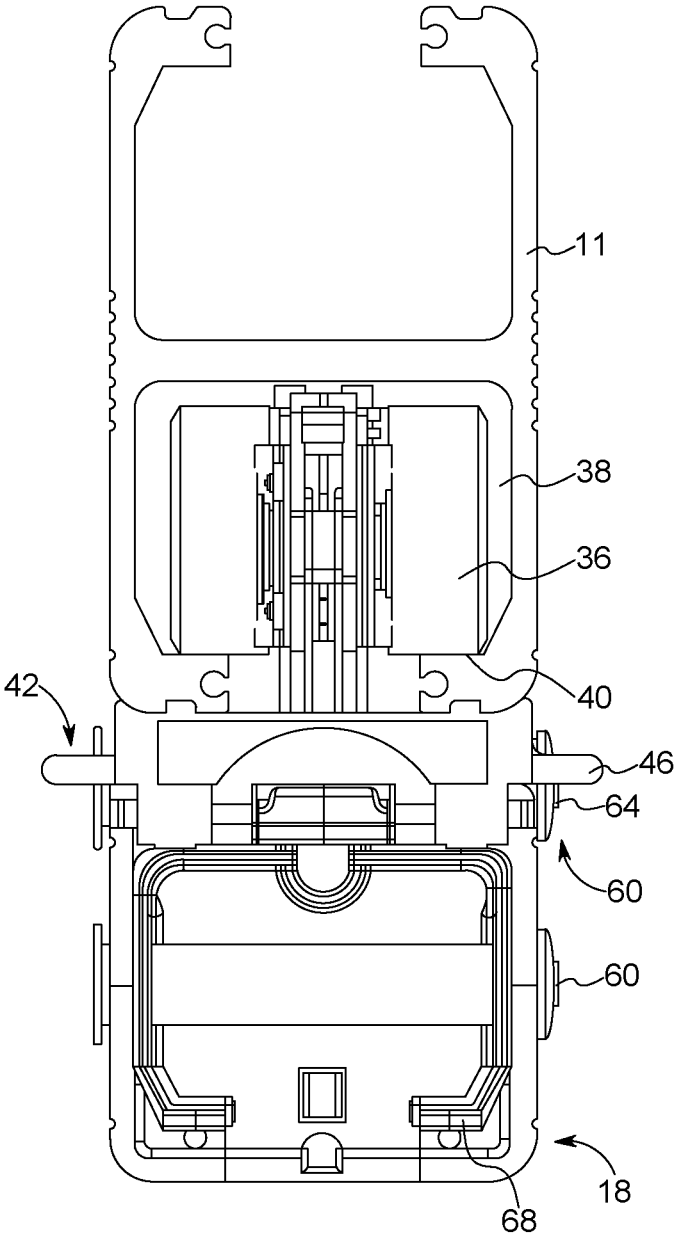
FIG. 9 is a front view of the receiving module of FIG. 4 with the door in the open position.
Figure 10:
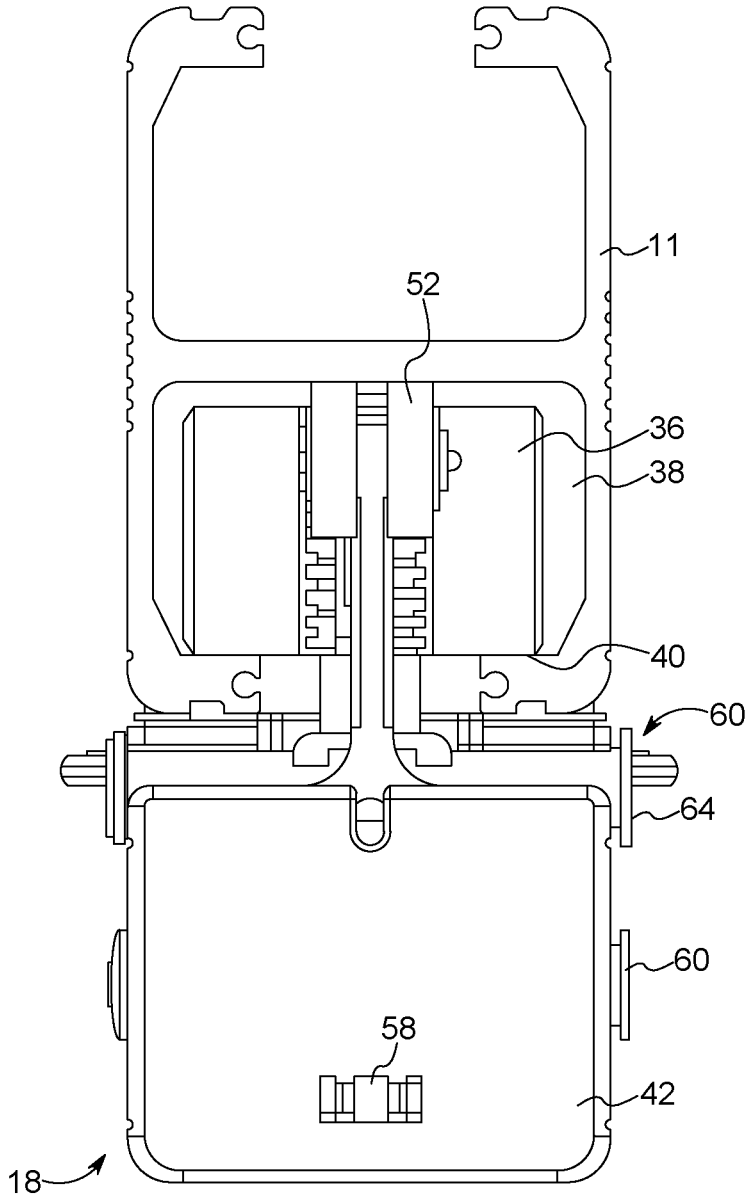
FIG. 10 is a front view of the receiving module of FIG. 4 with the door in a closed position.

FIGS. 4-8 show the receiving module 18 according to one aspect of the present disclosure. In FIG. 4, the receiving module 18 is shown installed on a track 11 and is slidably movable along the track 11 to move a patient to any desired location along the track length. The receiving module 18 includes a housing or receptacle 20 operatively connected to the track 11 via track connector 21. In one aspect, the receiving module 18 and the hoist assembly 12 are electrically connected to receive power from a single source and/or may receive data from a controller (not shown). In one embodiment, the housing 20 includes a bottom face 22, a top face 24, and four side surfaces 26, 28, 30, 32. As shown in FIG. 5, the track connector 21 includes a flange 34 extends from the top face 24 of the housing or receptacle 20. In one aspect, the track connector 21 further includes at least two wheel bearings 36 rotatably journaled on the flange 34. One wheel bearing 26 may be positioned opposite one another on opposing sides of the flange 34. In one aspect, two wheel bearings 36 are provided on each side of the flange 34. In another aspect, four wheel bearings 36 are positioned on each side of the flange 34. As shown in FIG. 9, the wheel bearings 36 and a portion of the flange 34 are positioned in an internal cavity 38 formed by the track 11. The wheel bearings 36 rest on a seat 40 of the track 11 and are slidable along the seat 40 to move the receiving module 18 to different positions along the track 11. The wheel bearings 36 may be moved manually by an individual or by a motor unit 37.

With reference to FIGS. 4-8, a door or cover 42 is hingedly connected to the housing or receptacle 20. The door or cover 42 is connected to the housing or receptacle 20 via a hinge 44. In one aspect, the hinge 44 extends through the top face 24 of the housing or receptacle 20, wherein the door or cover 42 is rotated upwards about hinge 44 so as to engage a lower surface of track 11 in door/cover 42's fully open state. The door or cover 42 is pivotably moveable between an open position and a closed position. In another aspect, the door or cover 42 is rotatable between the open position and the closed position. In one aspect, a sensor (not shown) may be provided to detect the open/closed position of the door or cover 42. In the open position, the door or cover 42 permits insertion and removal of a motor unit/hoist assembly 37 into/from the receiving module 18. In the closed position, the door or cover 42 prevents removal or insertion of a motor unit/hoist assembly 37 into/from the receiving module 18. The door or cover 42 may include one or more tabs or wings or grips 46 extending from a side thereof to assist an individual in opening and closing the door or cover 42. In one embodiment, two tabs or wings or grips 46, may extend from opposing sides of door or cover 42 beyond the sides of housing or receptacle 20 to facilitate opening and closing of door or cover 42.

As shown in FIGS. 6-8, 11, and 12, the door or cover 42 includes a friction point or latch 48 provided on a top side of the door or cover 42 that assists in locking the door or cover 42 in the open position to facilitate insertion/removal of a portion of a hoist assembly 12, such as a hoist assembly connector or portion of a motor unit 37, within the receiving module 18. The door or cover 42 is shown in the closed position in FIG. 11. In one aspect, the friction point or latch 48 is part of or integral with the door or cover 42. In another example, the friction point or latch 48 may be a tab, protrusion, projection, or extension attached to or extending from the door or cover 42.

Figure 11:
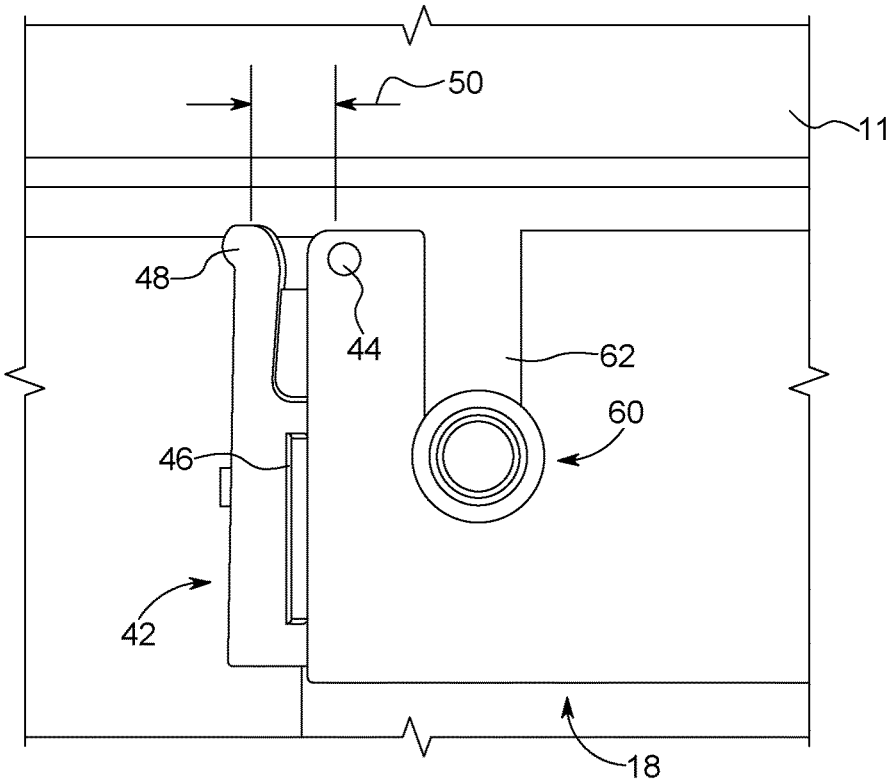
FIG. 11 is a side view of the receiving module of FIG. 4 with the door in a closed position and a slider element in a locked position.

In the illustrated embodiment, the door or cover 42 has a tongue or cantilever element spaced apart from and off set with hinge 44 that is capable of bending and flexing when door or cover 42 is full opened and engages track 11. The friction point or latch 48 is profiled so that it acts similarly to a cam, in that it engages against the bottom surface of the track 11 with a variable force due to interference between the friction point or latch 48 and the track 11 that changes depending on the angular position of the door or cover 42. In one aspect, the friction point or latch 48 is not engaged against the track 11 when the door or cover 42 is in its closed position. For example, as shown in FIG. 11, the friction point or latch 48 of the door or cover 42 is offset a first distance 50 from the hinge 44 that connects the door or cover 42 to the housing or receptacle 20 when the door or cover 42 is in the closed position. However, it should be appreciated that in other embodiments, the friction point or latch 48 may be engaged against the track 11 in the closed position. In any event, as the door or cover 42 is rotated from the closed position to the open position, the friction point or latch 48 will contact and slide against the bottom surface of the track 11. As the friction point or latch 48 slides against the track 11, the profile of the friction point or latch 48 creates an interference that creates the need for the individual to apply an increased force to move the door or cover 42 to its fully open position.

Figure 12:
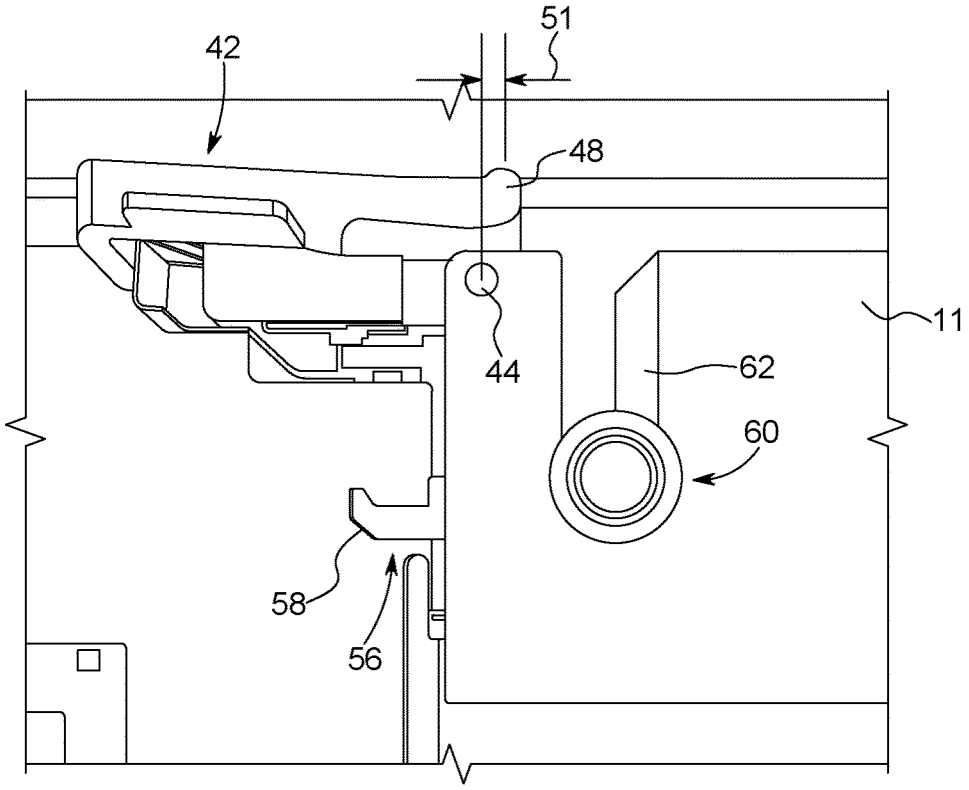
FIG. 12 is a side view of the receiving module of FIG. 4 with the door in an open position and the slider element in the locked position.

In one aspect, the interference force between the friction point or latch 48 and the bottom surface of the track 11 will at least partially decrease once the door or cover 42 reaches or approaches the open position. In this way, the friction point or latch 48 reaches a maximal interference engagement force during the transition of the door or cover 42 from the closed position to the open position. In one aspect, this is accomplished by setting an offset 51 between the friction point or latch 48 and the axis of the hinge 44, as shown in FIG. 12. This drop in interference force may be accomplished in any other manner, e.g., providing the friction point or latch 48 with an ellipse or semi-ellipse-shaped profile and setting the open position of the door or cover 42 at a position in which engagement of the friction point or latch 48 against the track 11 is rotated to an orientation just beyond the vertex of the ellipse (with the maximal interference engagement force occurring in this example when the track 11 is engaged with the vertex of the elliptical shape). In this way, the door or cover 42 remains in the open position until an increased external force (e.g., by a user) is exerted on the door or cover 42 in order to overcome the maximal interference engagement force between the friction point or latch 48 and the track 11, and return the door or cover 42 to its closed position. In one aspect, the interference force in the open position is about 30% less than the maximal interference engagement force. In one aspect, an individual may need to apply between about 20-25 N of force to the door or cover 42 to move the friction point or latch 48 past the maximal interference engagement.

In the manner described above and herein, the friction point or latch 48 may thereby act as an immobilizing brake along the track 11 to hold the door or cover 42 in the open position during insertion/removal of a motor unit 37 into the receiving module 18. By maintaining a sufficient degree of interference force even when the door or cover 42 is in the open position, the friction point or latch 48 may also act as an immobilizing feature or parking brake for the receiving module 18 when the door or cover 42 is moved to the open position to substantially prevent the receiving module 18 from moving along the track 11.

After the door or cover 42 has been rotated sufficiently to the open position (e.g., by moving the friction point or latch 48 past the maximal interference engagement), the door or cover 42 is held in the open position. In the open position, the door or cover 42 and the friction point or latch 48 rest against the track 11 so as to act as a parking brake that secures and locks the receiving module 18 at the particular position on the track 11. By locking the receiving module 18 in the current position, the receiving module 18 is prevented from moving while an individual inserts/removes a motor unit 37 into/from the receiving module 18. Opening the door or cover 42 also allows from access into an internal cavity defined by the receiving module 18 to insert/remove the motor unit 37. The door or cover 42 is held in the open position such that the individual does not need to hold the door or cover 42 while he/she attempts to insert/remove the motor unit 37.

The door or cover 42 effectively acts as a lever or actuator to trigger or activate the braking feature provided by interference between the friction point or latch 48 and the track 11 as described above. Accordingly, the receiving module 18 may be automatically put into a braked condition along the track 11 when the door or cover 42 is opened. As noted above, the door or cover 42 is typically opened when removal or insertion of the motor unit/hoist assembly 37 is desired from/into the receiving module 18, and it is in these situations when it is typically desirous to have the receiving module 18 in a braked condition (i.e., in order to facilitate in the aforementioned removal/insertion). Advantageously, therefore, the very act of opening the door or cover 42 automatically puts the receiving module 18 in a braked condition without a user needing to remember to activate or trigger a separate braking assembly. Alternatively stated, in this way, the system may be arranged such that the receiving module 18 must be braked when the hoist assembly 37 is removed from and/or inserted into the receiving module 18, since these actions can only be performed when the door or cover 42 is opened, and the act of opening the door or cover 42 automatically enables the braking functionality by actuating the friction profile 48 into engagement against the track 11 as described above.

In one aspect, when the door or cover 42 is held in the open position, there may be an approximately 1 mm interference between the friction point or latch 48 on the end of the door or cover 42, such that the door or cover 42 is bent against the track 11, thereby creating a parking brake effect for the receiving module 18. In the open position, the door or cover 42 creates a friction force against the track 11 resulting in the parking brake force. The friction force is great enough so as to prevent the receiving module 18 from moving along the track 11, ensuring the receiving module 18 remains stationary during the replacement of the motor unit 37 in the receiving module 18. After the motor unit 37 has been inserted/removed from the receiving module 18, the door or cover 42 can be moved from the open position to the closed position to close the receiving module 18. Similar to opening the door or cover 42, the individual must apply a sufficient downward force on the door or cover 42 to rotate the door or cover 42 through the interference engagement between the friction point or latch 48 on the door or cover 42 and the track 11. Once the door or cover 42 has been moved past the interference engagement, the door or cover 42 can be rotated down into the closed position to secure the new motor unit in the receiving module 18.

As shown in FIGS. 5 and 9-12, due to the additional force applied to the receiving module 18 when the door or cover 42 is moved between the open and closed positions and/or when receiving the hoist assembly 12, the receiving module 18 may experience a rotation or rocking of the opposing side face 28, 32 of the housing or receptacle 20. When the individual pushes the door or cover 42 upwardly to move the friction point or latch 48 past the interference engagement with the track 11, the upward force exerted by the individual forces the hinge 44 of the door or cover 42 to push down against the housing or receptacle 20. As the hinge 44 pushes against the housing or receptacle 20, the opposing end of the housing or receptacle 20, e.g. side face 28 opposite the door or cover 42, may begin to rotate upwardly towards the track 11. To counter-balance this upward movement of the housing or receptacle 20, counter supports 52 may be provided on the housing or receptacle 20 to prevent the housing or receptacle 20 from rotating upwardly towards the track 11 and to keep the receiving module 18 substantially level (or parallel) with the track 11 and/or in a stable orientation. The present disclosure provides for a few different aspects of the counter supports 52 on the housing or receptacle 20.

Figure 13:
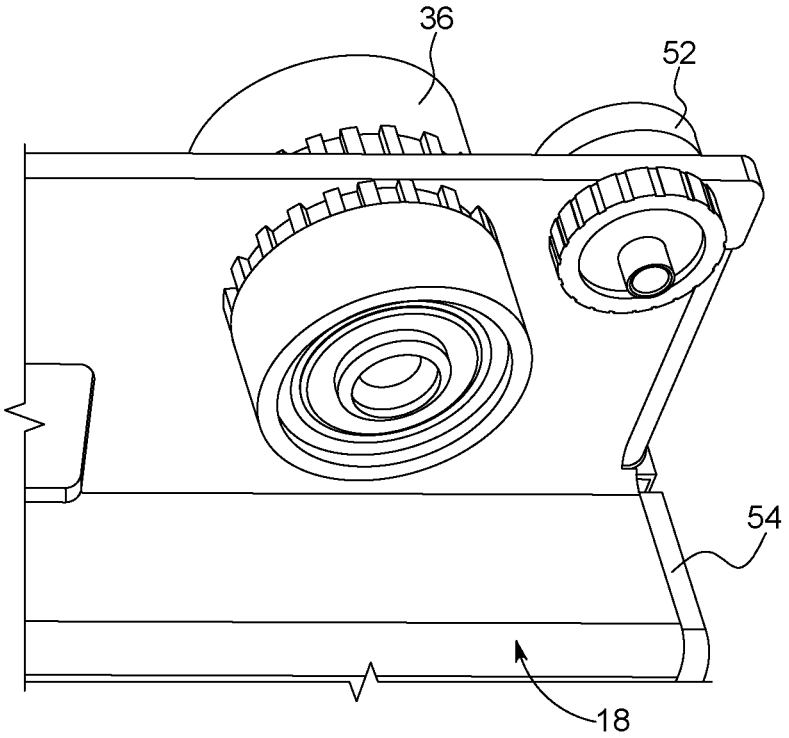
FIG. 13 is a perspective view of a counter support according to one aspect of the present disclosure on the receiving module of FIG. 4.

As shown in the embodiment of FIG. 13, in one aspect of the present disclosure, at least one counter support 52 may be provided on the flange 34 or track connector 21. By providing the counter support 52 on the flange 34, the counter support 52 is positioned in the internal cavity 38 of the track 11 when the receiving module 18 is positioned on the track 11. In one aspect, the counter support 52 is a wheel bearing that is journaled on the flange 34. In one aspect, one counter support 52 is provided on one side of the flange 34 and another counter support 52 is provided opposite the first counter support 52 on the opposing side of the flange 34 so as to extend upwards from the upper surface of the flange 34. The counter supports 52 are positioned proximate to or against a beam in the track 11. When opening the door or cover 42 on the housing or receptacle 20 and as the housing or receptacle 20 begins to rotate relative to the track 11, an upper surface of the counter supports 52 bear against the inner beam of the track 11 to prevent rotation of the housing or receptacle 20 relative to the track 11, thereby ensuring the housing or receptacle 20 remains substantially level and stable while the door or cover 42 is opened. The counter supports 52 may be positioned to prevent any rotation of the housing or receptacle 20 or may be positioned to allow a minimal rotation of the housing or receptacle 20 relative to the track 11. In either aspect, the counter supports 52 should be configured to keep the housing or receptacle 20 substantially parallel to the track 11.

Figure 14:
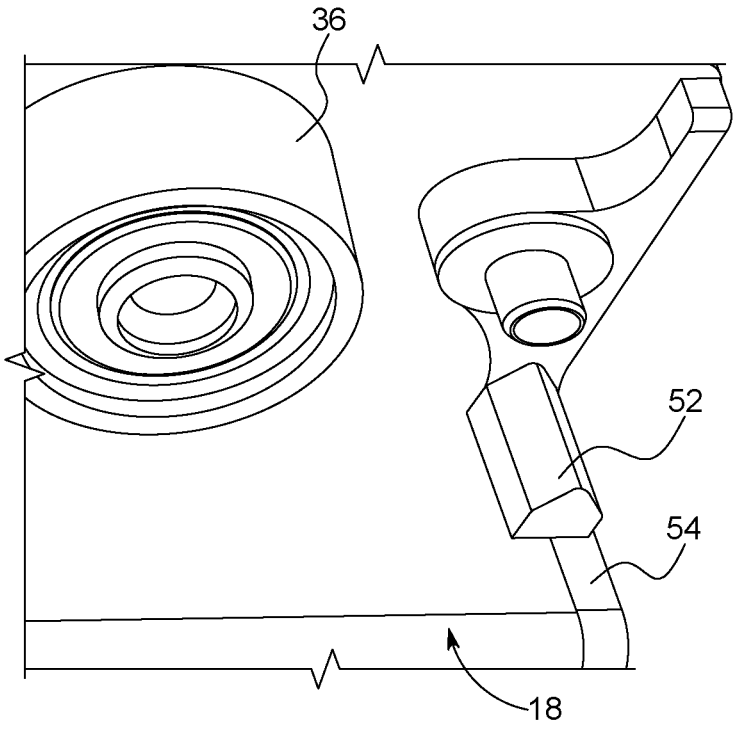
FIG. 14 is a perspective view of a counter support according to another aspect of the present disclosure on the receiving module of FIG. 4.
Figure 15:
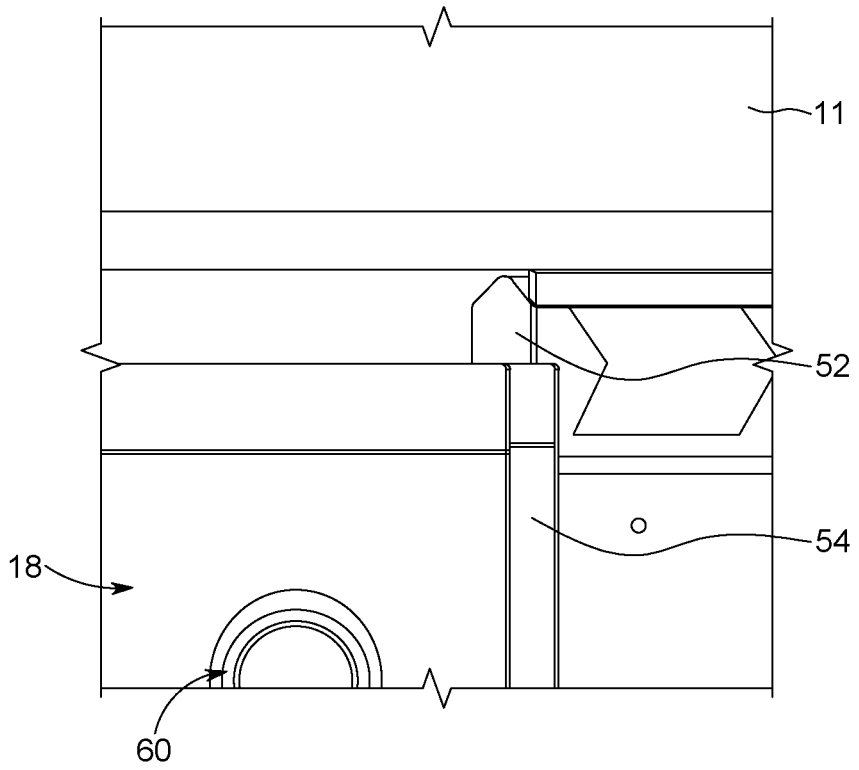
FIG. 15 is a side view of the counter support of FIG. 14 in a dis-engaged state.
Figure 16:
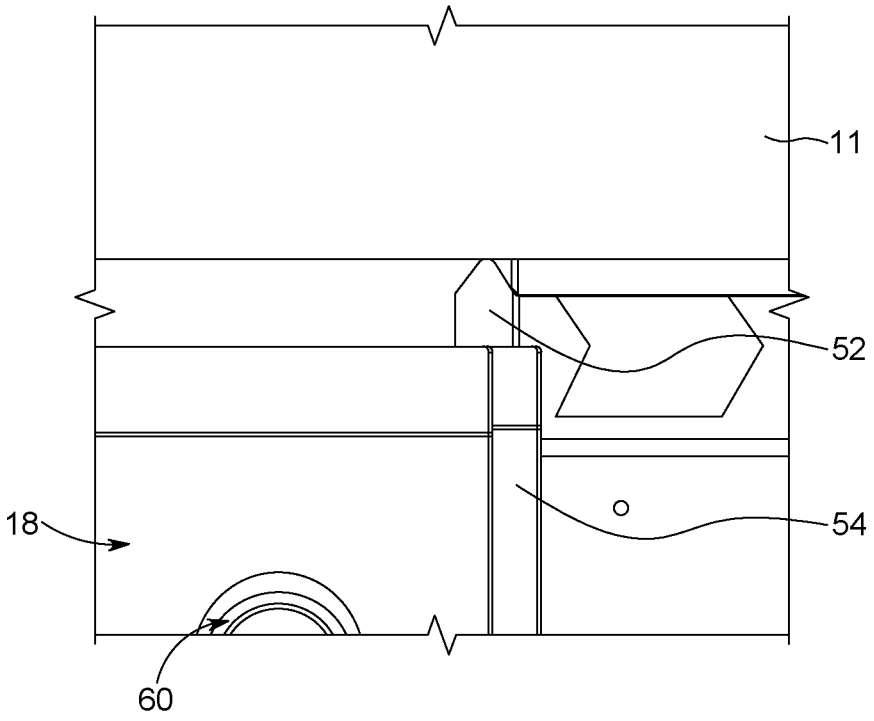
FIG. 16 is a side view of the counter support of FIG. 15 in an engaged state.
Figure 17:
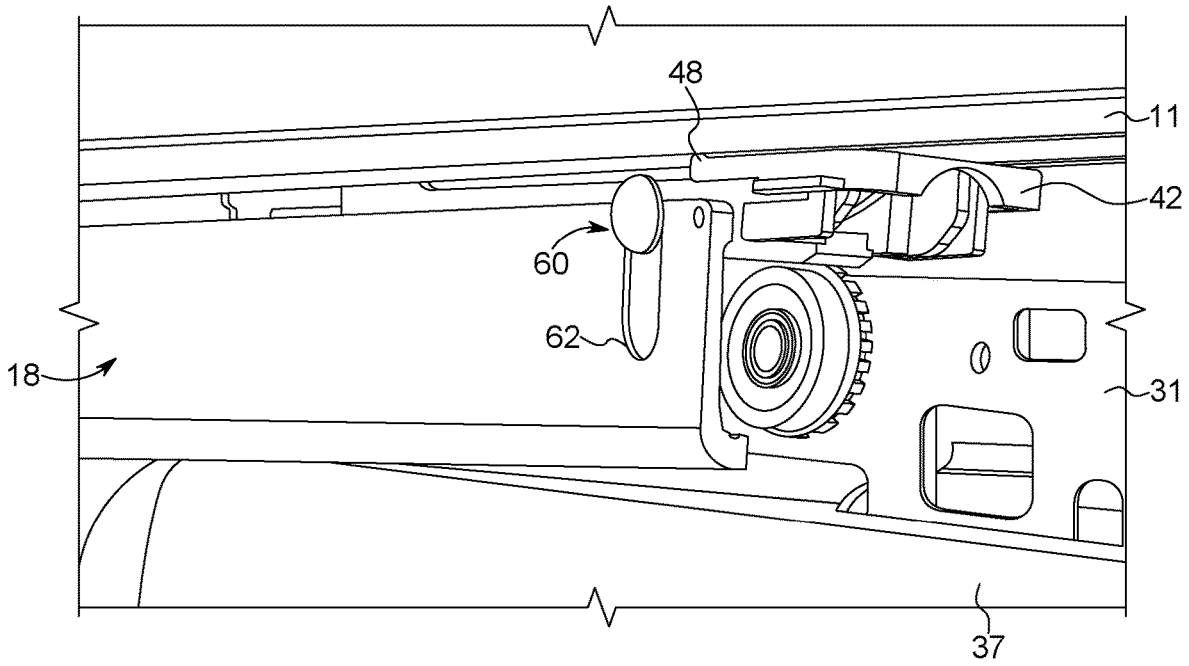
FIG. 17 is a perspective view of the receiving module of FIG. 4 receiving a motor unit.

As shown in FIGS. 14-16, in another aspect of the present disclosure, at least one counter support 52 is provided on the top face 24 of the housing or receptacle 20. In one aspect, the counter support 52 is a protrusion that extends upward from the top face 24 of the housing or receptacle 20. In one aspect, the protrusion may be formed integral with the housing or receptacle 20 or may be a separate component attached to the top face 24 of the housing or receptacle 20. In another aspect, the protrusion may also be formed on a rear access door 54 and/or may be hingedly connected to the flange 34. In one aspect, one counter support 52 is provided on the housing or receptacle 20. In another aspect, one counter support 52 extends upwards from an upper surface of the housing or receptacle 20 on one side of the flange 34 and another counter support 52 is provided on the housing or receptacle 20 on an opposite side of the flange 34 from the first counter support 52. Since the counter support 52 is provided on the top face 24 of the housing or receptacle 20, the counter support 52 is provided below a lower surface of the track 11 when the receiving module 18 is coupled to the track 11. When the receiving module 18 is positioned on the track 11, the counter supports 52 are positioned proximate to or bear against the outside bottom surface of the track 11. Due to the interference between the friction point or latch 48 and the track 11, the housing or receptacle 20 may begin to rotate relative to the track 11 when the door or cover 42 is opened. In this instance, the counter supports 52 bear against the outside bottom surface of the track 11 to prevent rotation of the housing or receptacle 20 relative to the track 11, thereby increasing the braking force of the receiving module 18 against the track 11 and ensuring the housing or receptacle 20 remains fixed and/or level while the door or cover 42 is opened. The counter supports 52 may be positioned to prevent any rotation of the housing or receptacle 20 or may be positioned to allow a minimal rotation of the housing or receptacle 20 relative to the track 11. In either aspect, the counter supports 52 should be configured to keep the housing or receptacle 20 substantially parallel to the track 11. It is also contemplated in another aspect of the disclosure that a receiving module 18 may include both the counter supports 52 of FIG. 13 and the counter supports 52 of FIGS. 14-16.

With reference to FIGS. 12-20, a self-securing locking arrangement for the receiving module 18 is described. A slider element or gate 56 is slidably positioned within the internal cavity defined by the housing or receptacle 20. The slider element or gate 56 is configured to move vertically within the housing or receptacle 20 towards and away from the track 11. In one aspect, the slider element or gate 56 includes a locking tab or slider latch 58 that extends out of the side face 32 of the housing or receptacle 20. In one aspect, the locking tab or slider latch 58 is curved upwards towards the track 11. The slider element or gate 56 is held within the housing or receptacle 20 via one or more retaining members 60 that are connected to and extend from the slider element or gate 56. In one aspect of the present disclosure, the retaining member 60 is configured as a bar or rivet that traverses the width of the housing or receptacle 20. The use of a rivet instead of a nut and bolt assembly may be advantageous since the rivets are permanently attached to the slider element or gate 56. Unlike a nut and bolt assembly, the rivet will not inadvertently disassemble during use of the receiving module 18. Nut and bolt assemblies may become disassembled do to inadvertent unscrewing.

One retaining member 60 extends from each side of the slider element or gate 56 and are received in slots 62 defined in the side faces 26, 30 of the housing or receptacle 20. Each retaining member 60 includes an enlarged head 64 that is positioned outside of the housing or receptacle 20 when the retaining member 60 is positioned in the slot 62. The head 64 of the retaining member 60 has a larger diameter than the diameter of the slot 62, thereby preventing the retaining member 60 from falling into the housing or receptacle 20. The retaining member 60 is movable vertically within the slot 62, which corresponds to the vertical movement of the slider element or gate 56 within the housing or receptacle 20. It is also contemplated that retaining members other than rivets may be used to retain and hold the slider element or gate 56 within the housing or receptacle 20, provided the retaining member 60 has an enlarged head that prevents the retaining member 60 from being displaced from the slot 62.

As shown in FIGS. 17-20, the slider element or gate 56 is configured as a self-locking element that falls into a locking position by gravity. When no pressure is applied to the slider element or gate 56, the slider element or gate 56 is configured to fall into a locking position in which the retaining members 60 are positioned in the bottom of the slots 62. When the slider element or gate 56 is in the locking position, the slider element or gate 56 prevents insertion of a portion of the hoist assembly 12 (e.g. a portion of the motor unit 37 or hoist connector 31 into the receiving module 18, but also prevents a motor unit 37 already installed in the receiving module 18 from sliding out of the receiving module 18. In one aspect, a sensor (not shown) may be provided to detect the open/closed position of the slider element or gate 56. As shown in FIG. 4, another pair of retaining members 60 are provided in the housing or receptacle 20 at an end of the housing or receptacle 20 opposite the door or cover 42. The retaining members 60 on this end of the housing or receptacle 20 assist in retaining a portion of the motor unit 37 within the receiving module 18 so that the motor unit 37 cannot slide with respect to the receiving module 18. When the motor unit 37 is installed in the receiving module 18, the motor unit 37 and the hoist connector 31 are held between the pairs of retaining members 60 provided in the housing or receptacle 20.

Figure 18:
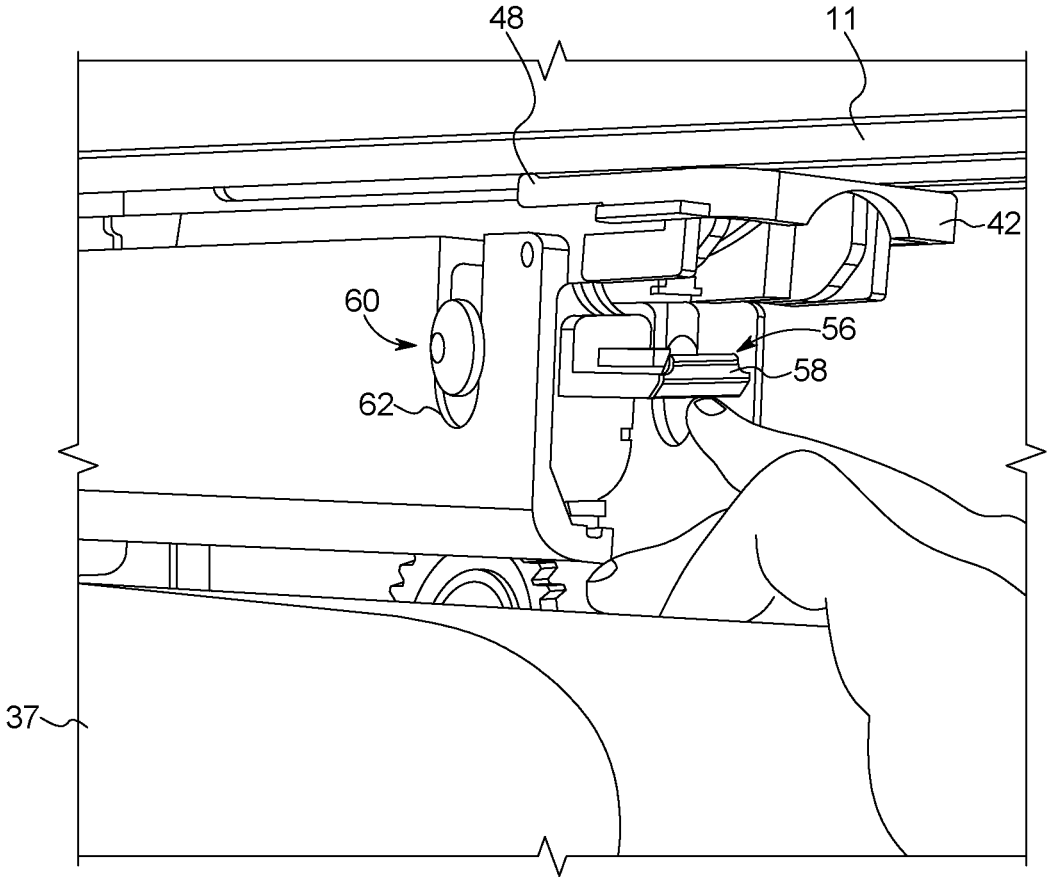
FIG. 18 is a perspective view of the receiving module of FIG. 4 with the motor unit installed therein.
Figure 19:
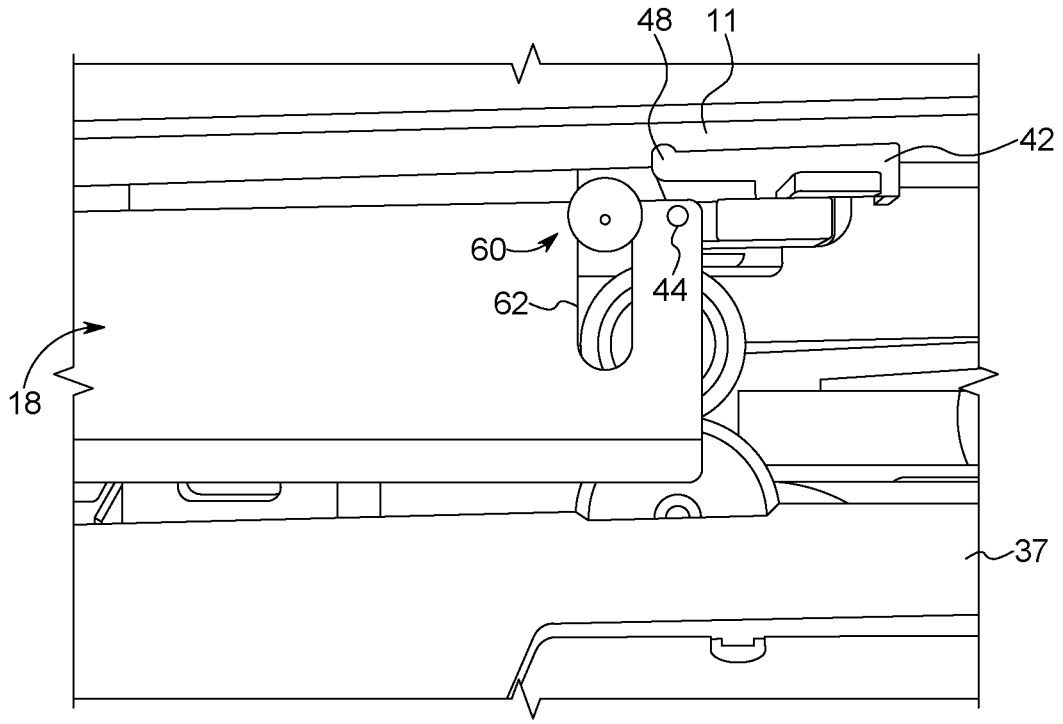
FIG. 19 is a side view of the receiving module of FIG. 4 receiving a motor unit.
Figure 20:
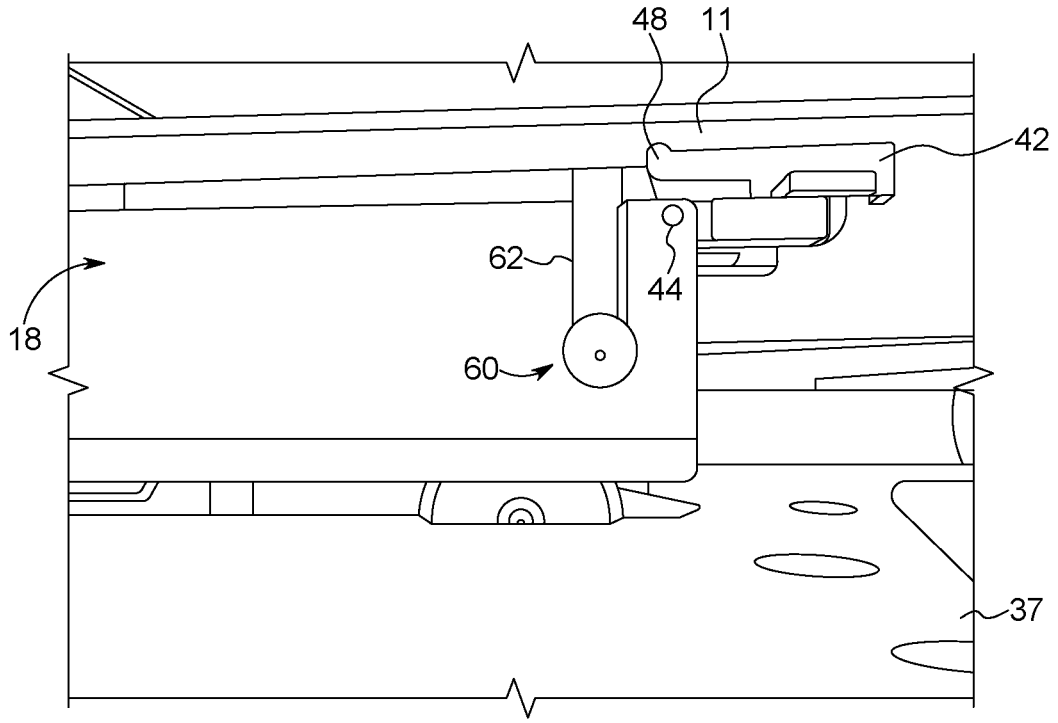
FIG. 20 is a side view of the receiving module of FIG. 4 with the motor unit installed therein.
Figure 21:
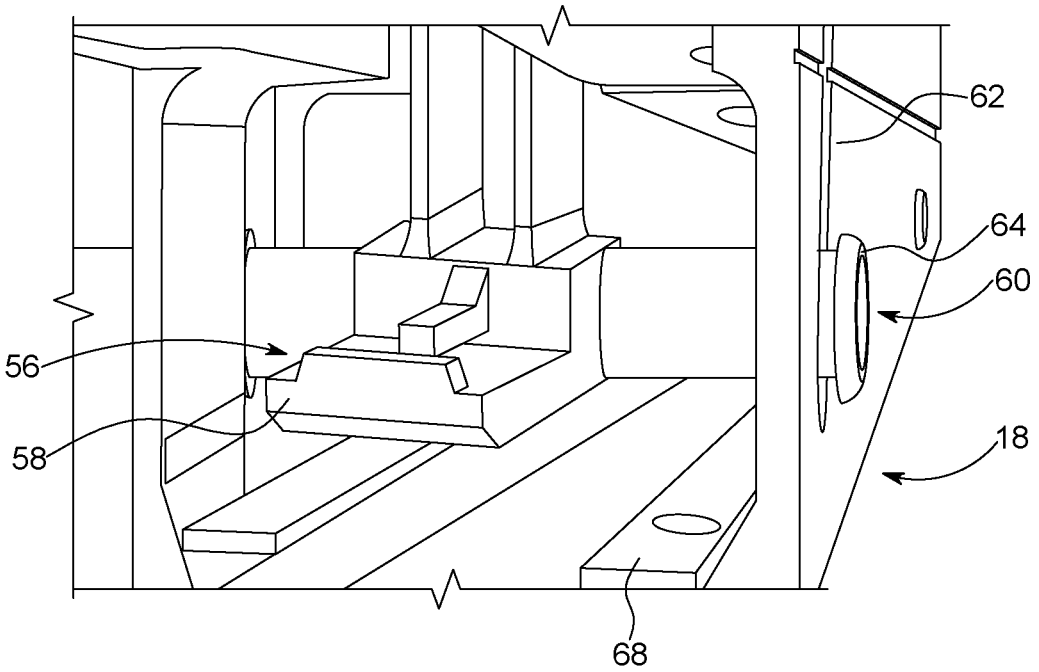
FIG. 21 is a front view of the slider element of the receiving module of FIG. 4.

The slider element or gate 56 is also configured to move to a receiving position when an individual applies an upward force on a bottom surface of the slider element or gate 56. As shown in FIG. 18, when the door or cover 42 is positioned in the open position, an individual can push up on the slider element or gate 56 to move the slider element or gate 56 vertically towards the track 11. Due to the vertical movement of the slider element or gate 56, the retaining members 60 are also moved vertically within the slots 62 towards the track 11. By moving the slider element or gate 56 towards the track 11, the slider element or gate 56 no longer prevents access to the internal cavity of the housing or receptacle 20. Therefore, the individual is intended to move the slider element or gate 56 vertically within the housing or receptacle 20 to permit a motor unit 37 to be removed therefrom or to be inserted therein. It is also contemplated that the individual may push the motor unit 37 to be installed in the receiving module 18 against the locking tab 58 of the slider element or gate 56 to move the slider element or gate 56 vertically within the housing or receptacle 20. Once the slider element or gate 56 has been moved vertically to the receiving position, the motor unit 37 can be slid into the housing or receptacle 20 to install the motor unit 37 within the receiving module 18. As the motor unit 37 is slid past the slider element or gate 56 in the housing or receptacle 20, the slider element or gate 56 will fall into the locked position due to gravity. Therefore, the individual does not need to manually move the slider element or gate 56 back into the locked position because the slider element or gate 56 is self-locking once the motor unit 37 moves past the slider element or gate 56 in the housing or receptacle 20.

With reference to FIGS. 4, 11, and 12, the locking tab or latch 58 of the slider element or gate 56 is used as an additional locking feature for the receiving module 18. While the slider element or gate 56 secures the motor unit 37 within the housing or receptacle 20 after the motor unit 37 has been slid past the slider element or gate 56, the door or cover 42 of the receiving module 18 remains open, which can allow dust and other potentially destructive debris into the receiving module 18. Therefore, the individual will close the door or cover 42 once the motor unit 37 has been installed in the receiving module 18. As the door or cover 42 is rotated downwards, the locking tab or latch 58 of the slider element or gate 56 is received in a slot 66 defined in the door or cover 42. As the door or cover 42 is rotated downwardly, the door or cover 42 will push the locking tab or latch 58 downwardly to allow the locking tab or latch 58 to move through the slot 66. As the locking tab or latch 58 moves through the slot 66, the locking tab or latch 58 snaps back into a locked position to secure the door or cover 42 in the closed position. The locking tab or latch 58 curves upwardly towards the track 11 so that a rotation of the door or cover 42 towards the open position is prevented, since the door or cover 42 will contact the curved portion of the locking tab or latch 58. The door or cover 42 remains locked in the closed position until the individual presses the locking tab 58 downwards away from the track 11 to allow the locking tab 58 to slide through the slot 66 in the door or cover 42. When the door or cover 42 is locked in the closed position, the door or cover 42 is prevented from being inadvertently being opened since a manual movement of the locking tab or latch 58 is required to move the locking tab or latch 58 out the locked position. To open the door or cover 42, the individual will move the locking tab or latch 58 in a downward direction away from the track 11 and will pull the tab or wing or grip 46 of the door or cover 42 to rotate the door or cover 42 to the open position.

Figure 22:
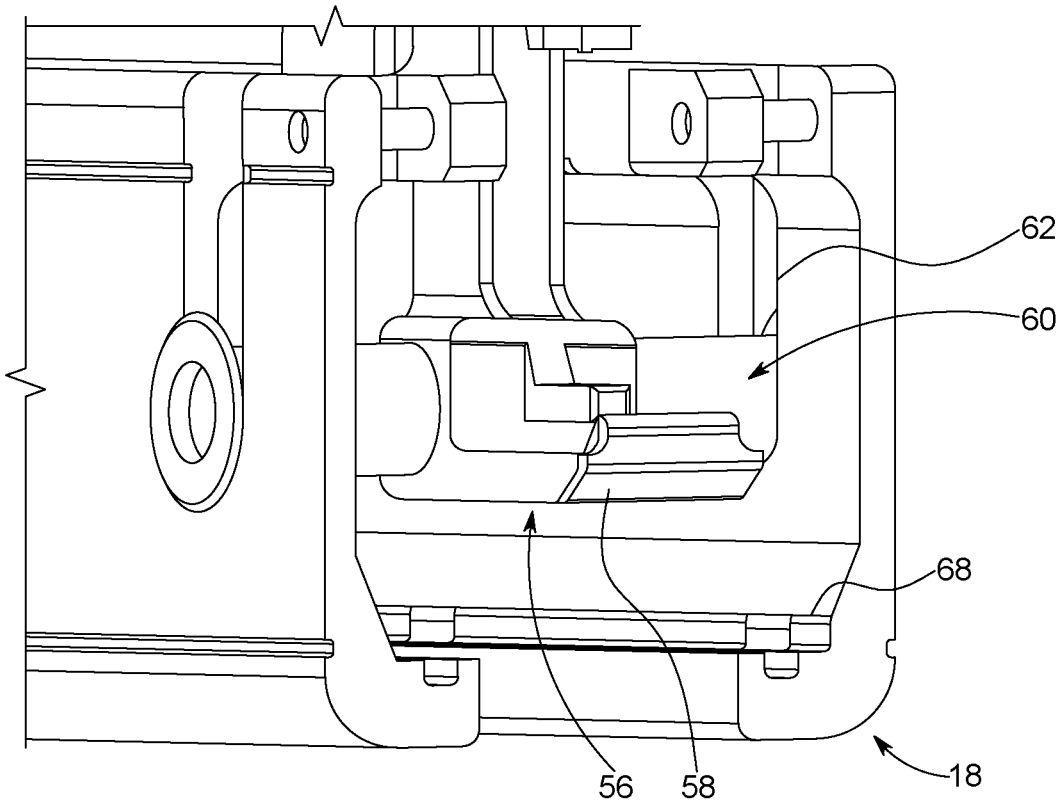
FIG. 22 is a perspective view of the slider element of the receiving module of FIG. 4.
Figure 23:
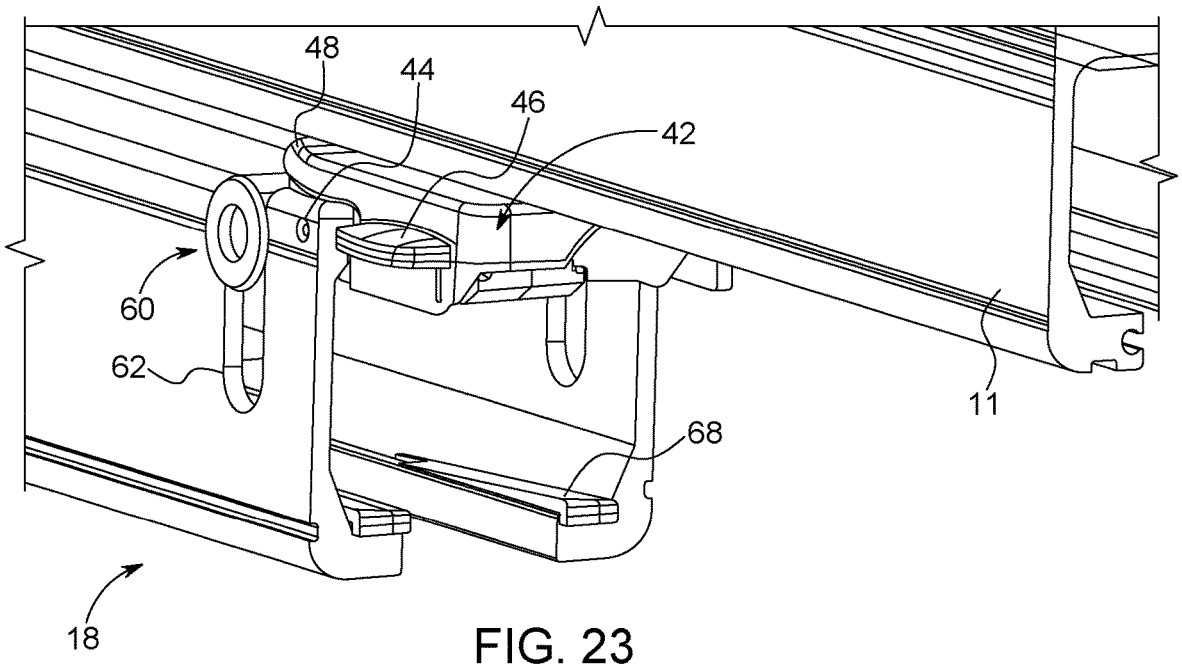
FIG. 23 is a perspective view of the receiving module of FIG. 4 with the slider element removed.
Figure 24:
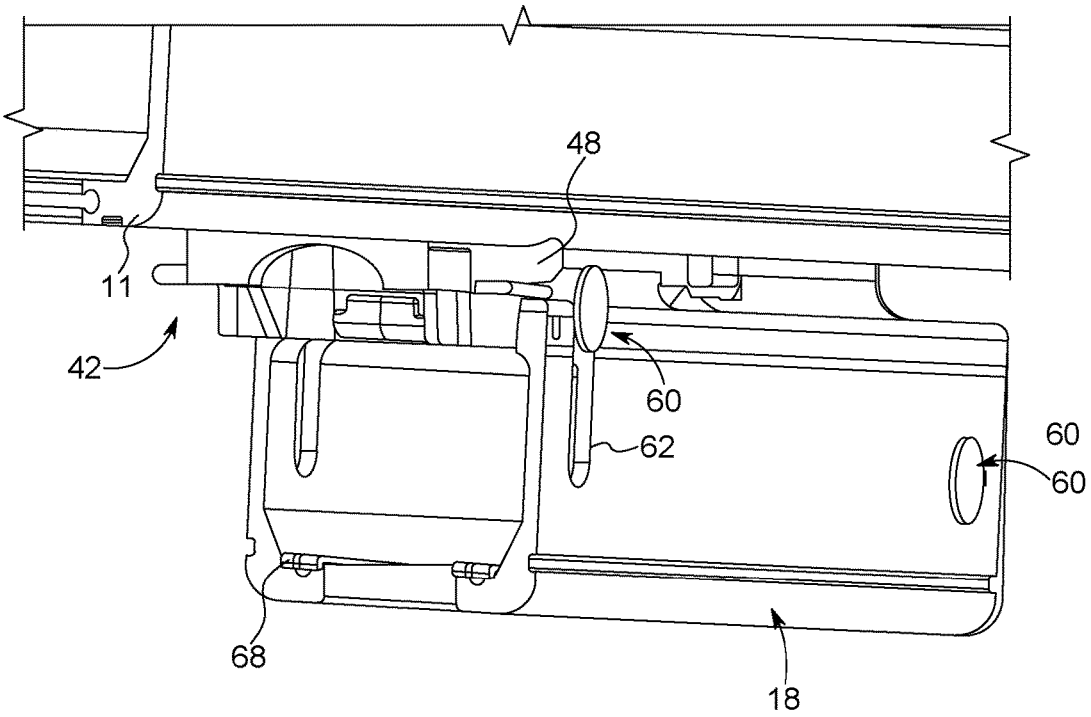
FIG. 24 is a perspective view of the receiving module of FIG. 4 with the slider element removed.
Figure 25:
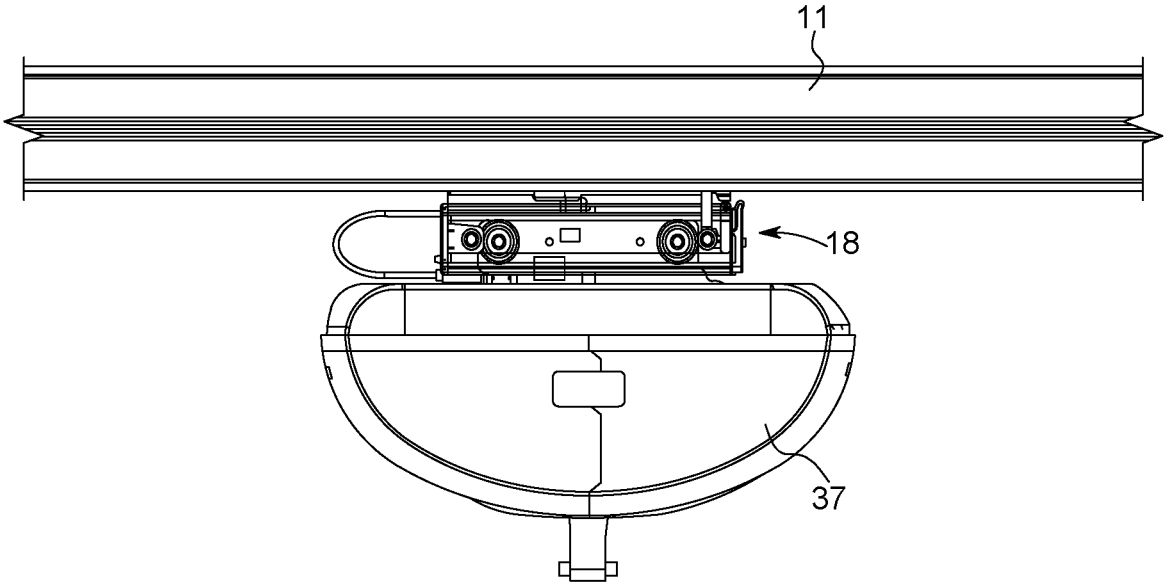
FIG. 25 is a side view of the receiving module of FIG. 4 and a motor unit installed therein.

With reference to FIGS. 22-24, an additional feature for securing the motor unit 37 in the receiving module 18 is described. To assist the individual in inserting the motor unit 37 into the receiving module 18, at least one step or ramp member 68 is provided in the internal cavity defined by the housing or receptacle 20. The step or ramp member 68 may be planar or curved in profile. In one aspect, two step or ramp members 68 are provided in the housing or receptacle 20. In one aspect, the step or ramp members 68 are formed integral with the housing or receptacle 20. In another aspect, the step or ramp members 68 are separate components attached to the housing or receptacle 20. The step or ramp members 68 extend from a bottom internal surface of the housing or receptacle 20 to assist the individual in inserting the motor unit 37 into the receiving module 18. The step or ramp members 68 are configured with a decreasing height from one end of the step or ramp member 68 to an opposing end of the step or ramp member 68. The higher end of the step or ramp members 68 are positioned adjacent the door or cover 42 of the receiving module 18. The lower end of the step or ramp members 68 are positioned further in the internal cavity of the housing or receptacle 20. During insertion of the motor unit 37 into the housing or receptacle 20, the step or ramp members 68 assist in self-securing the motor unit 37 within the receiving module 18. After the individual has inserted at least a portion of the motor unit 37 into the receiving module, wheel bearings on the motor unit 37 will roll down the inclined surfaces of the step or ramp members 68 such that the motor unit 37 will roll into place in the receiving module 18 without further assistance or pushing from the individual. As the motor unit 37 rolls along the step or ramp members 68, the wheels of the motor unit 37 will roll onto a level surface of the internal cavity of the housing or receptacle 20 and the slider element or gate 56 will fall into the locking position to self-secure the motor unit 37 within the receiving module 18. A side view of motor unit 37 installed within a receiving module 18 is provided in FIG. 25.

Figure 26:
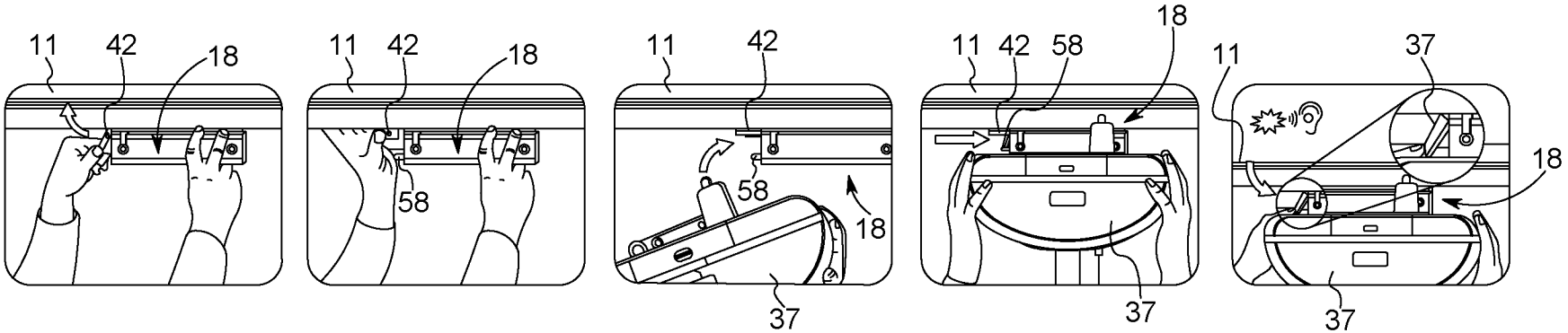
FIG. 26 is a schematic drawing illustration a method for installing a motor unit in the receiving module of FIG. 4.

With reference to FIG. 26, a method for installing a motor unit 37 in the receiving module 18 is described. In one aspect of this method, the receiving module 18 and the hoist assembly 12 are electrically connected to receive power from a single source and/or may receive data from a controller (not shown). After the receiving module 18 has been installed on the track 11, the door or cover 42 is opened and set in a "parking brake" mode to secure the receiving module 18 at the present location on the track 11. To open the door or cover 42, the individual must push down on the locking tab or latch 58 of the slider element or gate 56 to permit the door or cover 42 to rotate to the open position. In one aspect, a sensor (not shown) may be provided to detect the open/close position of the door or cover 42. Opening the door or cover 42 on the receiving module 18 allows for access to the internal cavity of the housing or receptacle 20. The individual then pushes the slider element or gate 56 upwardly towards the track 11 either manually or using an upper surface of the motor unit 37. In one aspect, a sensor (not shown) may be provided to detect the open/closed position of the slider element or gate 56. The individual then pushes the hoist connector 31 or a portion of the motor unit 37 into the receiving module 18 to permit the hoist connector 31 or a portion of the motor unit 37 to roll down the step or ramp members 68 in the housing or receptacle 20. As the motor unit 37 rolls down the step or ramp members 68 into an installed position, the slider element or gate 56 will fall back into a locked position to self-secure the hoist connector or the portion of the motor unit 37 to the receiving module 18.

The individual then rotates the door or cover 42 downwardly into the locked position. As the door or cover 42 rotates into the locked position, the locking tab or latch 58 of the slider element or gate 56 locks into the door or cover 42 to secure the door or cover 42 in a locked position on the receiving module 18. As the locking tab 58 snaps into place in the door or cover 42, an audible indication is issued to notify the individual that the door or cover 42 has been locked. The audible indication may be created by the lowering of the gate or slider element 56, lowering of retaining members 60, and/or the latching of the locking tab or latch 58 to door or cover 42.

Figure 27:
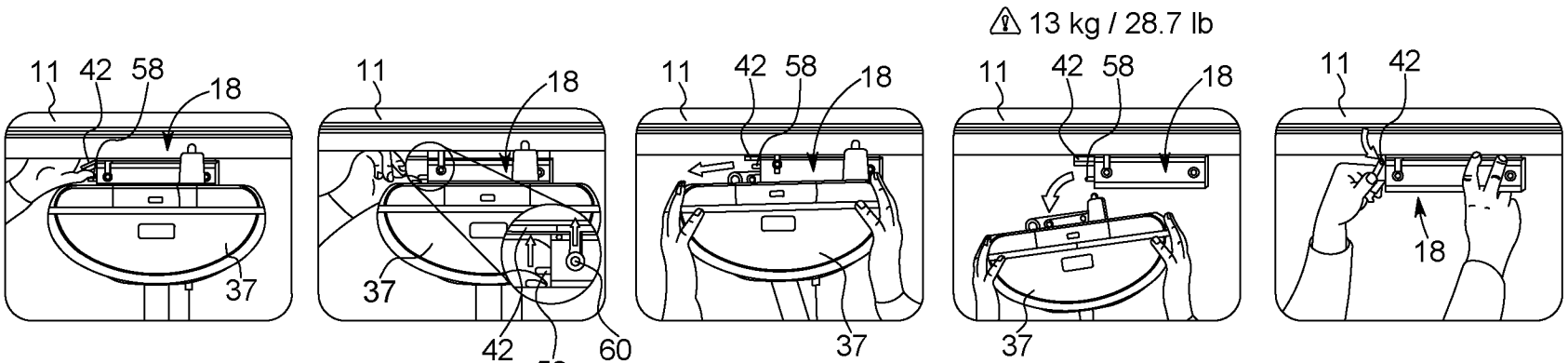
FIG. 27 is a schematic drawing illustration a method for removing a motor unit from the receiving module of FIG. 4.

With reference to FIG. 27, a method of removing a motor unit 37 from the receiving module 18 is described. In the event a motor unit 37 is to be removed from the receiving module 18, the individual will open the door or cover 42 to permit access to the internal cavity of the housing or receptacle 20. The individual will then push the slider element or gate 56 upwardly towards the track 11 to unlock the motor unit 37 within the receiving module 18. As the slider element or gate 56 is moved upwardly, the retaining members 60 also move upwardly within the slots 66. With the slider element or gate 56 moved to the open position, the individual can remove the motor unit 37 by pulling the motor unit 37 out of the housing or receptacle 20. After the motor unit 37 has been removed from the receiving module 18, the door or cover 42 is moved to the locked position to close the receiving module.

While several examples of the receiving module are shown in the accompanying figures and described in detail hereinabove, other aspects will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. A receiving module for a ceiling patient lift, wherein the receiving module is a trolley, which is slidingly movable along on a track, the receiving module comprising:

a housing defining an internal cavity configured to hold a motor unit;

a door hingedly connected to a side face of the housing, the door being configured to move between a first position in which the door is closed and is configured to prevent access to the internal cavity of the housing, and a second position in which the door is open and configured to actuate a brake configured to secure the receiving module relative to the track, and wherein the door is configured to directly engage a portion of the track to lock the door to the track in the open position, and wherein the door has a friction point or latch provided on a top side of the door that is configured to assist in locking the door in the open position;

a slider element operatively connected to the housing;

at least one retaining member connected to the slider element and slidably receiving in a side face of the housing;

at least one counter support provided on an upper surface of the housing; and at least one ramp member provided in the internal cavity of the housing.

2. A lift system for lifting and transferring a person, wherein the lift system comprises:

a hoist assembly for lifting a person; and the receiving module according to claim 1 engagable with the track, wherein the slider element comprises the at least one retaining member traversing a width of the housing, wherein the housing is configured for removably receiving a portion of the hoist assembly such that the hoist assembly is detachably coupled to the housing; and wherein the door is pivotable, allowing access to the interior cavity of the housing and securing the portion of the hoist assembly within the housing.

3. The lift system of claim 2, wherein the door is configured to be snap fit with respect to a portion of the track, thereby locking the door to the track in the open position.

4. The lift system of claim 2, wherein the door is pivotably hinged to the housing about a pivot point spaced apart from the track, said friction point or latch positionable between the pivot point and the track to secure the door to the track in the open position and prevent movement of the receiving module.

5. The lift system of claim 2, wherein the door is pivotably hinged to the housing about a pivot point spaced apart from the track, and wherein the door further comprises a tongue with a tab at an end thereof adjacent to and offset from the pivot point.

6. The lift system of claim 2, wherein the housing is configured as a housing comprising four side faces, an upper face and a lower face, wherein a slot is defined within the lower face for accommodating a portion of the hoist assembly.

7. The lift system of claim 2, wherein the door is pivotably positioned by a user in the first and second positions by manually rotating the door.

8. The lift system of claim 2, wherein the housing has a seat adjoining an edge of the housing opening adjacent to the door, to secure the portion of the hoist assembly within the housing.

9. The lift system of claim 2, wherein the at least one counter support is configured to adjust the position of the receiving module so that the receiving module is substantially stable and/or level when the door is open and/or when receiving the portion of the hoist assembly within the housing.

10. The lift system of claim 2, wherein the door further comprises a tab extending from a side of the door out beyond a side of the housing to facilitate opening and closing of the door.

11. The lift system of claim 2, wherein the hoist assembly comprises a hoist connector and a motor unit extending therefrom.

12. The lift system of claim 2, wherein the receiving module is removably attached to the track, and wherein the receiving module comprises a plurality of wheel bearings movable along a length of the track.

13. The lift system of claim 2, wherein the receiving module and the hoist assembly are electrically connected and powered by a single source and/or directed by a single controller.

* * * * *